US006488069B1

(12) United States Patent
Mashaw et al.

(10) Patent No.: US 6,488,069 B1
(45) Date of Patent: Dec. 3, 2002

(54) RAIN DUMP STRUCTURE FOR AWNING

(75) Inventors: Michael Mashaw, Anthony, NM (US); Michael Hicks, El Paso, TX (US); Alejandro Carrillo, Dearborn, MI (US); Kody Sparks, Las Cruces, NM (US)

(73) Assignee: Dometic Corporation, Elkhart, IN (US)

( * ) Notice: Subject to any disclaimer, the term of this patent is extended or adjusted under 35 U.S.C. 154(b) by 0 days.

(21) Appl. No.: 09/620,482

(22) Filed: Jul. 20, 2000

(51) Int. Cl.[7] ..... E04F 10/06

(52) U.S. Cl. ..... 160/67; 160/44; 160/63; 160/262

(58) Field of Search ..... 160/67, 66, 22, 160/69, 70, 71, 78, 79, 80, 65, 262, 63, 237, 44; 135/88.11, 88.12

(56) References Cited

U.S. PATENT DOCUMENTS 3,075,805 A * 1/1963 Golde et al. ..... 160/262
3,722,571 A 3/1973 Knight et al.
3,834,400 A 9/1974 Sattler
4,033,397 A * 7/1977 McKee ..... 160/67 X
4,160,458 A 7/1979 Marcellus
4,508,126 A 4/1985 Everard
5,148,848 A 9/1992 Murray et al.
5,273,095 A * 12/1993 Lukos ..... 160/70
5,449,032 A 9/1995 Blevins et al.
6,095,221 A * 8/2000 Frey ..... 160/67
6,098,693 A * 8/2000 Frey ..... 160/67

* cited by examiner

*Primary Examiner*—David M. Purol
(74) *Attorney, Agent, or Firm*—Pearne & Gordon LLP

(57) ABSTRACT

An awning assembly adapted to automatically lower an edge of a canopy under a predetermined weight collected on the canopy to remove some of the collected weight from the canopy and thereafter return the canopy to its original position. The awning assembly includes an arm assemblies comprising a vertically extending base arm secured at the wall, a bottom arm having a first end pivotally connected to the base arm, an extended arm having a first end pivotally connected to the bottom arm and a second end supporting the awning arm, and a top arm having a first end pivotally connected to the extended arm. Another arrangement for the arm assemblies includes a rafter arm having an inner end pivotally connected to the wall and an outer end pivotally connected to the a support arm, the support arm has an outer end connected to and supporting the awning arm and an inner end removably connected to the wall. The above arms can automatically change effective lengths under loaded conditions by utilizing an elastic assembly. Each arm assembly can also include a strut with an inner end connected to the wall and an outer end connected to the top arm or the rafter arm to work in concert with said elastic assembly. Alternatively, the awning configuration can include a support arm, canopy rod or canopy made of a resilient flexible material which deflects when the predetermined load has collected on the canopy.

23 Claims, 13 Drawing Sheets

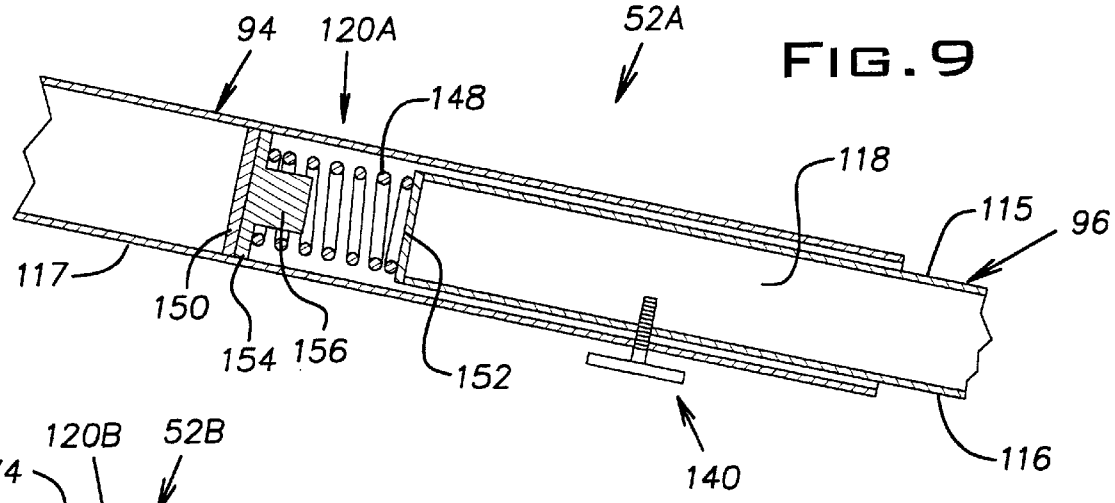
FIG. 9
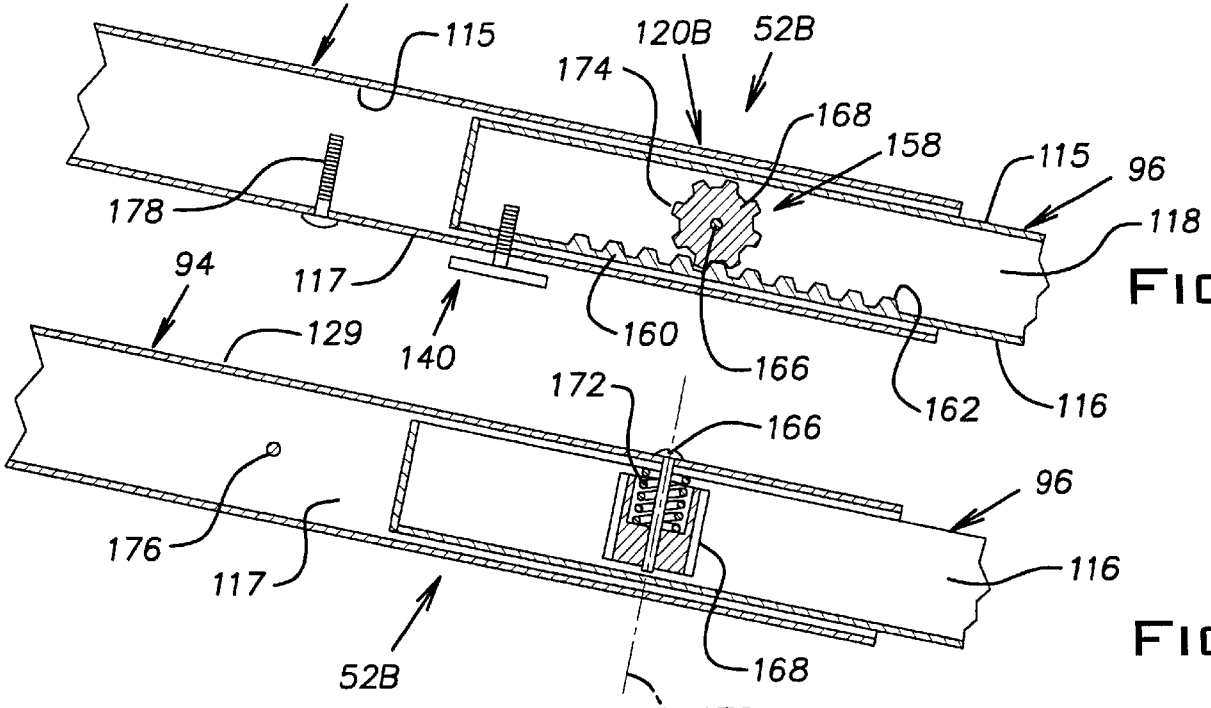
FIG. 10
FIG. 11

56C
96
115
118
228
226
116
130
132
216
120C
140
208
134
94
212
129
100
99
52C
16C
14
13
94A
262
263
256
264
66
198
70
69
98
258
62
260
60
64
58
50
74
68
54
181
184
180
182

RAIN DUMP STRUCTURE FOR AWNING

BACKGROUND OF THE INVENTION

The present invention generally relates to awning assemblies of the type to be mounted to a substantially vertical support surface and, more specifically, to such awning assemblies which drain water from a canopy.

There are a number of known awning assemblies that support an awning or canopy to create a sheltered area. An inner end of the canopy is typically secured to a wall and an outer end of the canopy is typically secured to a roller assembly. The roller assembly is supported at its ends by support arms for movement between a retracted position, wherein the roller assembly is disposed adjacent the wall, and an extended position, wherein the roller assembly is extended out away from the wall. When the roller assembly is in the retracted position, the canopy is rolled-up on the roller assembly. When the canopy is in the extended position, the canopy is unrolled from the roller assembly and extends between the wall and the roller assembly. These awning assemblies are often designed for use with movable support structures such as, for example, recreation vehicles, travel trailers, mobile homes, and the like, but are also usable with fixed structures.

Water typically collects on the extended canopy during rainfall. The water pools on the canopy and the natural deflection of the canopy and the roller tube caused by the weight of the canopy, roller tube and collected water. The weight of the pooled water may cause damage to the awning assembly and also should be drained prior to retracting the awning assembly. To remove the water from the canopy, operators often push the canopy upwards, with a pole or stick, to raise the deflected portion to a height that allows the water to drain over a side of the canopy. This method of removing water often damages the canopy, is time consuming, and may cause discomfort by splashing water onto the operator. Accordingly, there is a need in the art for an improved awning assembly which automatically drains collected rain water from a canopy.

BRIEF SUMMARY OF THE INVENTION

The present invention provides an awning assembly which automatically lowers an edge of a canopy under a predetermined weight so to remove some of the collected weight. According to the present invention, the awning assembly includes a canopy having an inner edge for connection at a wall and an outer edge. The outer edge of the canopy is supported by an arm assembly. The awning assembly is adapted to lower an edge of the canopy under a predetermined weight collected on the canopy such that some of the collected weight is removed from the canopy.

According to an embodiment of the present invention, the awning assembly further comprises an elastic assembly connected to the arm assembly. The elastic assembly cooperates with the arm assembly to automatically change the effective length of the arm assembly when the predetermined weight has collected on the canopy so to cause an edge of the canopy to lower to remove some of the collected weight from the canopy.

According to another aspect of the invention the predetermined weight is in a range of 8 pounds to 50 pounds.

According to a further aspect of the invention the effective length of the arm assembly changes by at least three inches when the predetermined weight has collected on the canopy.

According to a still further aspect of the invention the arm assembly can be a pair of arm assemblies and the awning assembly can further comprises a canopy rod. The canopy rod is connected to the canopy and has opposite ends each supported by one of the arm assemblies. Additionally, the arm assemblies can include a vertically extending base arm connected to the wall, a bottom arm having an inner end pivotally connected to the base arm, an extended arm having an inner end pivotally connected to the bottom arm and an outer end connected to and supporting the canopy rod. The top arm has an inner end pivotally connected to the base arm above the bottom arm and an outer end pivotally connected to the extended arm. Further, the top and/or bottom arm can include a second member slidably connected to a first member wherein the elastic assembly is connected to the first and/or the second member. Still further, the second member can be slidably movable with respect to the first member in a telescoping manner.

According to another aspect of the present invention the elastic assembly includes a rack attached to the second member, a pinion attached to the first member and engaging the rack, and a spring attached to the pinion. The spring can be a torsion spring.

According to yet another aspect of the present invention the extended arm includes a first member and a second member pivotally connected, and the spring assembly is connected to at least one of the members.

According to a further aspect of the present invention at least one of the arm assemblies includes a strut having an inner end connected to the wall and an outer end connected to the top arm. Alternatively, the inner end of the strut can be connected to the arm assembly.

According to a still further aspect of the present invention the canopy rod includes two bars pivotally connected at their inner ends and have outer ends supported by the arm assemblies and the spring assembly is connected to at least one of the bars.

According to another aspect of the present invention each of the arm assemblies includes a rafter arm having an inner end pivotally connected at the wall and an outer end pivotally connected to a support arm. The support arm has an outer end connected to and supporting the canopy rod and an inner end connectable at the wall. Additionally, at least one of the support arm can include a lock assembly operable to keep at least one of the support arm from changing effective length when the awning assembly is loaded. Further, the second member can be slidably moveable with respect to the first member in a telescoping manner.

According to another embodiment of the present invention, the canopy has an inner edge for connection at the wall. The outer edge of the canopy is connected to the canopy rod. The canopy rod has opposite ends supported by a pair of air assemblies. Each arm assembly includes a rafter arm and a support arm. Each rafter arm has an inner end pivotally connected to the wall and an outer end pivotally connected to the support arm. The support arm has an outer end connected to and supporting the canopy rod and an inner end connectable to the wall. One of the support arms is made of a resilient flexible material such that the support arm deflects to reduce the effective length when a predetermined weight has collected on the canopy.

According to still another embodiment of the present invention the awning assembly comprises a canopy having an inner edge for connection at a wall. An outer edge of the canopy is supported by a pair of arm assemblies and is connected to a canopy rod. The canopy rod has opposite ends each supported by one of arm assemblies. The canopy rod includes a bar having a section made of a resilient flexible material such that the canopy rod automatically deflects when a predetermined weight has collected on the canopy. The deflection causes an edge of the canopy to lower so to remove some of the collected weight from the canopy.

According to a further embodiment of the present invention the awning assembly comprises a canopy having an inner edge for connection at a wall. At least one arm assembly supports an outer edge of the canopy. The canopy has a section made of a material of higher elasticity than a remaining portion of the canopy. The higher elastic section of the canopy stretches more than the remaining portion to form a valley in the canopy when a predetermined weight has collected on the canopy.

According to still another embodiment of the present invention the awning assembly comprises a canopy having an inner edge for connection at a wall and an outer edge connected a canopy rod. The canopy rod has angularly extending grooves in which the outer edge of the canopy is connected. The canopy rod has opposite ends which are supported by a pair of arm assemblies. The grooves can twist between about 90 degrees and 180 degrees about the canopy rod.

DESCRIPTION OF THE SEVERAL VIEWS OF THE DRAWING

These and further features of the present invention will be apparent with reference to the following description and drawings, wherein:

FIG. 9 is an enlarged fragmented view, similar to FIG. 8, but showing a compression spring as the spring assembly.

FIG. 10 is an enlarged fragmented view, similar to FIG. 8, but showing a rack and pinion spring assembly as the spring assembly.

FIG. 11 is an enlarged fragmented view, in cross-section taken along line 11—11 of FIG. 5, showing the rack and pinion spring assembly of FIG. 10.

DETAILED DESCRIPTION OF PREFERRED EMBODIMENTS

Figure 1:
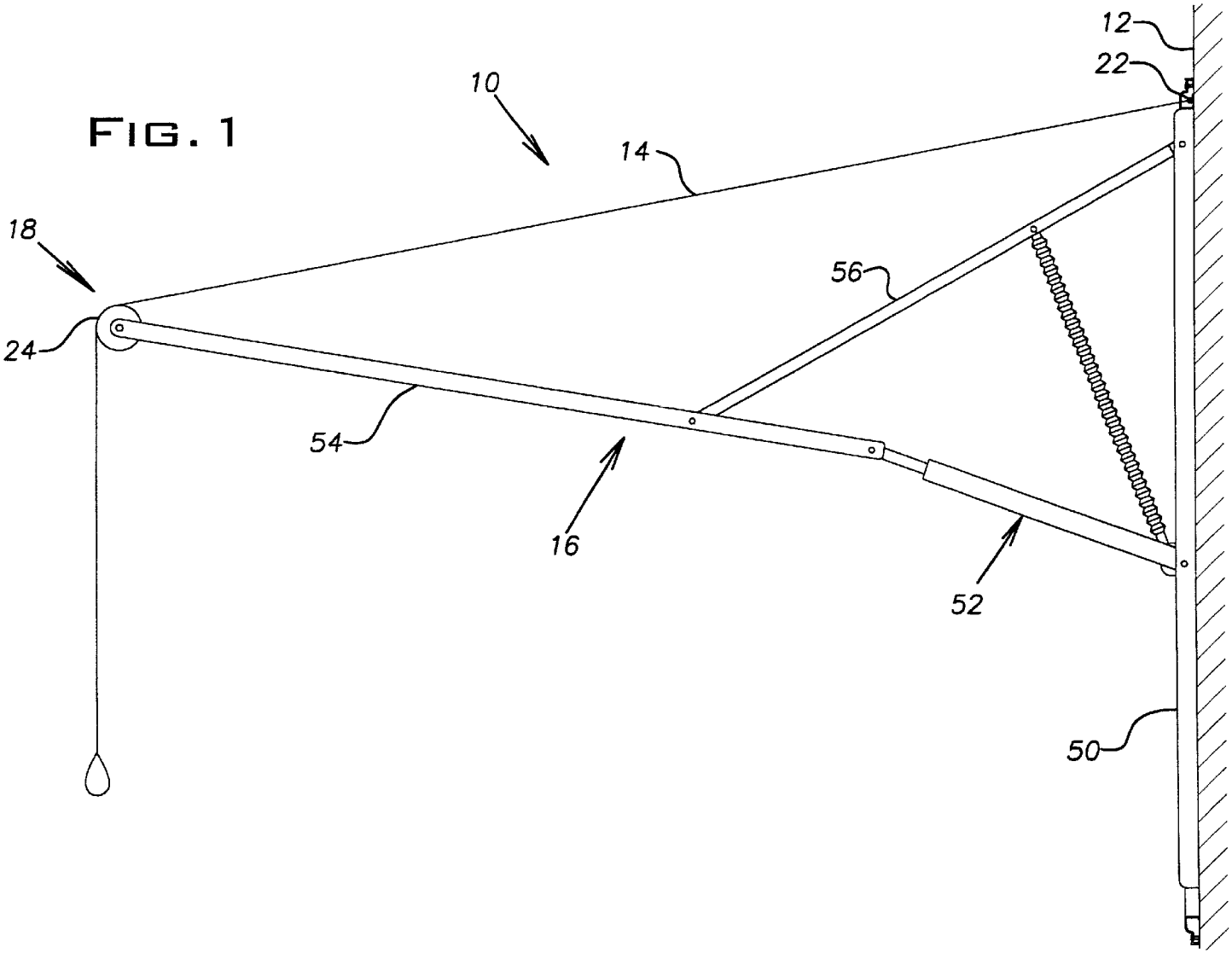
FIG. 1 is a side elevational view of an awning assembly having a rain dump structure, according to the present invention, in a deployed position.

FIG. 1 illustrates a first embodiment of an awning assembly 10 according to the present invention. The awning assembly 10 is attached to a vertically-extending support wall 12 such as a side of a recreational vehicle. The term "recreational vehicle", as used in the specification and claims, includes campers, travel trailers, mobile homes, vans, buses, and the like. While the awning assembly 10 is particularly advantageous when attached to recreational vehicles, it can alternatively be attached to other vertically-extending walls such as, for example, the side of a building at a patio or deck or any other transportable or fixed structure.

The awning assembly 10 can be manually or automatically operable between a stored position and an extended position (shown in FIG. 1). In the extended position, the awning assembly 10 provides a covering position to protect against sun, rain, and the like. During rainfall, once a predetermined amount of water has collected on a canopy 14, the effective length of an arm automatically adjust to allow collected water to drain off the canopy 14. After the water drains off the canopy 14, the arm automatically returns to its original position.

The awning assembly 10 includes a canopy 14 for selectively covering an area adjacent to the wall 12 and right and left arm assemblies 16 for directly supporting the canopy 14 or indirectly supporting the canopy 14 by supporting opposite sides of a canopy rod 18. The canopy 14 is a sheet of flexible material such as, for example, fabric, canvas, acrylic, or nylon and is preferably rectangularly shaped. An inner edge of the canopy 14 is secured to the support wall 12 and an outer edge of the canopy 14 is secured to a canopy rod 18. The inner and outer edges of the canopy 14 are preferably provided with an awning rope or other suitable cylindrical member. The awning rope is preferably a polypropylene rope and is preferably sewn in a hem or pocket formed at the edges of the canopy 14.

The rope at the inner edge of the canopy 14 is preferably held by an awning rail 22 which extends horizontally along and is fixedly attached to the support wall 12 by suitable fasteners. The awning rail 22 is preferably an aluminum extrusion having a channel formed therein for retaining the awning rope in a known manner. The inner edge of the canopy 14 can be alternatively secured to the support wall 12 in other manners such as, for example, directly to the support wall 12 or to a cover attached to the wall 12. The awning rope at the outer edge of the canopy 14 is held by the canopy rod 18. The canopy rod 18 preferably includes a roller assembly 24 as described in more detail hereinafter.

Figure 2:
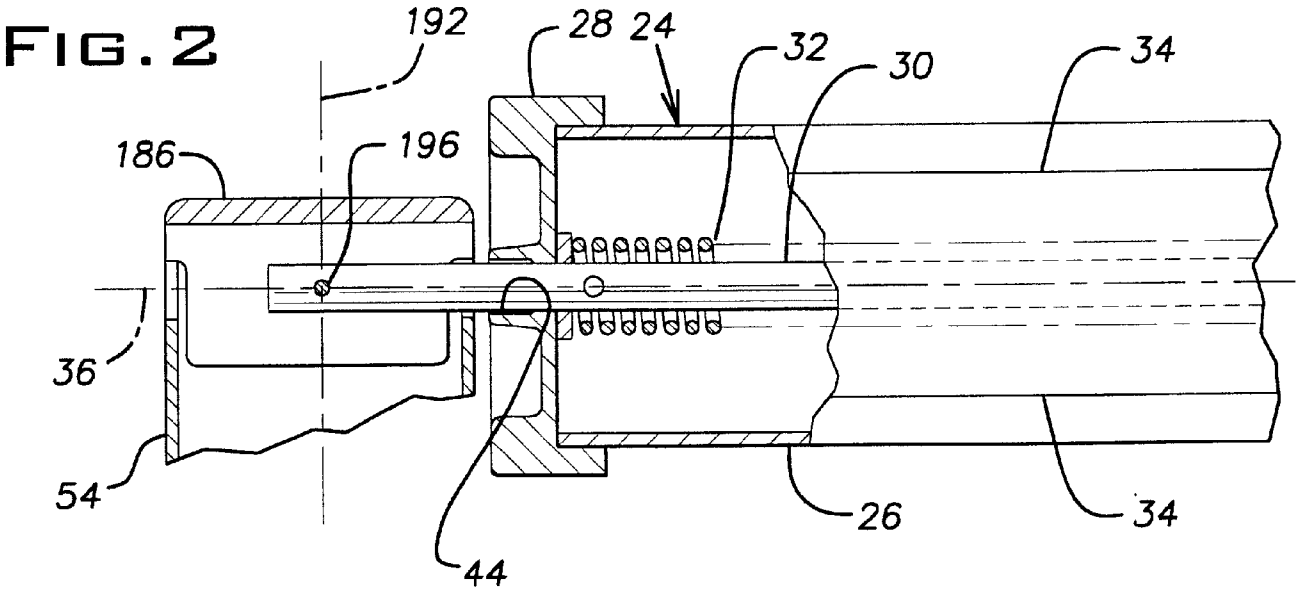
FIG. 2 is an enlarged and fragmented elevational view, partially in cross-section, showing an end of a roller assembly.
Figure 3:
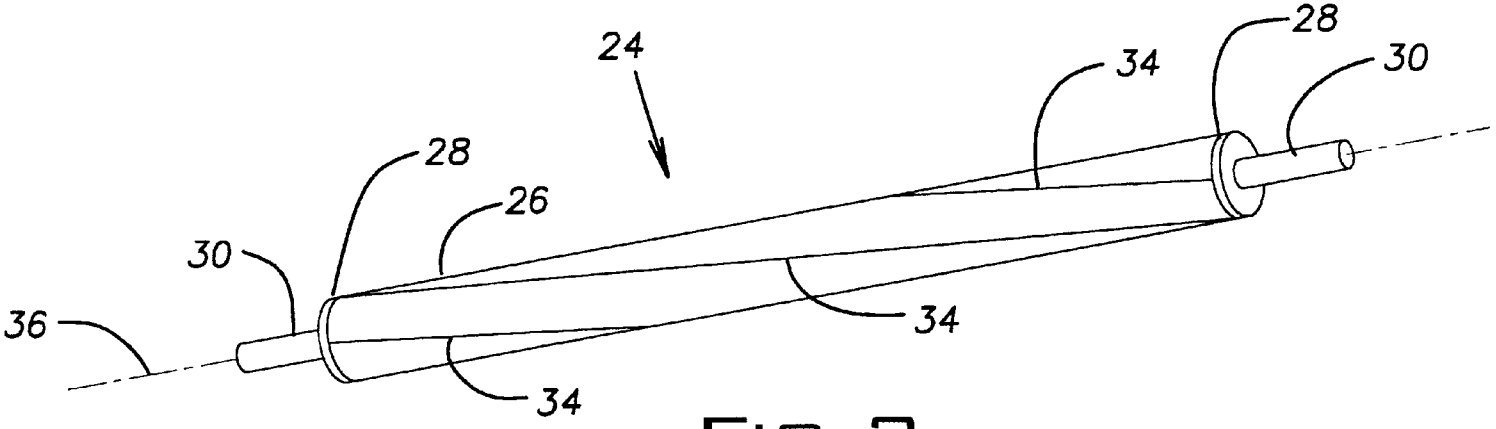
FIG. 3 is an enlarged perspective view of a roller assembly having angular grooves.

As shown in FIG. 2, a suitable roller assembly 24 includes a roller tube 26, a pair of end caps 28 closing open ends of the roller tube 26, at least one axle or roller bar 30 which rotatably supports the roller tube 26, and at least one torsion spring 32. The roller tube 26 preferably has longitudinally or angularly extending channels or grooves 34 formed therein. The grooves 34 can be parallel with the rotational axis 36 of the roller tube 26 or can be angular or twist up to 180 degrees around the roller tube 26 (shown in FIG. 3). The awning rope of the outer edge of the canopy 14 is secured to one of the grooves 34 in a known manner. When the awning rope is secured to an angular groove 34, the groove 34 causes one side of the inner end of the canopy 14 to be lower than the opposite side of the inner end of the canopy 14.

The end caps 28 are rigidly secured to the roller tube 26 for rotation therewith and have a central opening 44 therein. At least one bar 30 extends through the central opening 44 such that the roller tube 26 and the end cap 28 are free to rotate together with respect to the bar 30. The bar 30 forms the rotational axis 36 for the roller tube 26 and supports the roller tube 26. The torsion spring 32 is disposed around the bar 30 within the roller tube 26. The torsion spring 32 is operably connected between the roller tube 26 and the bar 30 in any known manner so that rotation of the roller tube 26 with respect to the bar 30 varies tension of the torsion spring 32. The torsion spring 32, therefore, can be advantageously preloaded for biasing the roller tube 26 to roll-up the canopy 14 onto the roller tube 26. Biased in this manner, the torsion spring 32 both tensions the canopy 14 when the awning assembly 10 is held in the extended position and furls the canopy 14 onto the roller tube 26 when the awning assembly 10 is moved from the extended position to the retracted position. Other configurations of roller assemblies and/or tensioning mechanisms can be utilized within the scope of the present invention.

The roller assembly 24 can also include a lock and release mechanism for selectively preventing rotation of the roller tube in one direction or the other. The lock mechanism can be of any suitable type. See for example, U.S. Pat. No. 5,732,756, disclosing a suitable lock mechanism for the roller assembly 10.

Figure 4:
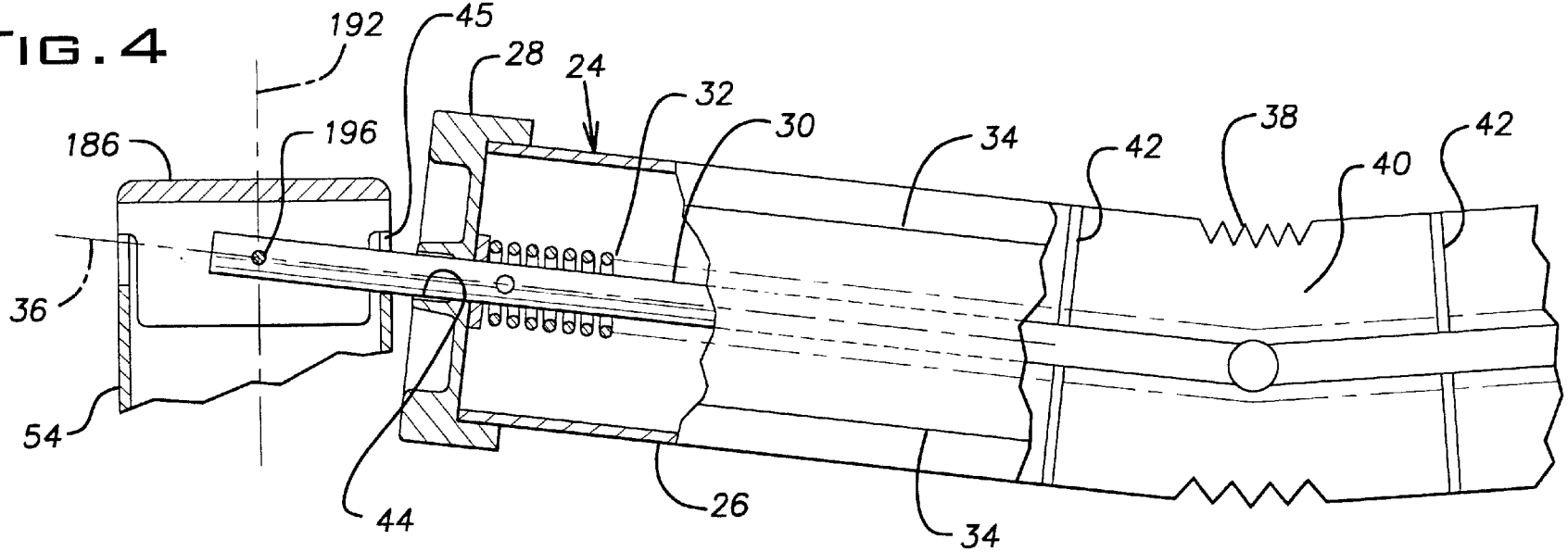
FIG. 4 is an enlarged and fragmented elevational view, partially in cross-section, showing a roller assembly with jointed roller bars.

As shown in FIG. 4, the roller tube 26 alternatively can have a flexible midsection 38. Disposed within the roller tube 26 are at least two roller bars 30 with inner ends connected in series with a joint 40. The joint 40 can be of any suitable mechanism such as, for example, a hinge or a ball in socket. The hinge 40 is secured to the inner ends of the two bars 30 to allow the bars to rotate downwards into a "V" shape. Spacers 42 are operationally disposed between the roller tube 26 and the bars 30 in any known manner to maintain distance between the roller tube 26 and the bars 30.

Each outer end of the roller bars 30 extends through a rectangular opening 45 in the outer end of the extended arm 54. Each outer end of the bars 30 is secured within the interior of the extended arm 54 with a pin 196. The roller bar 30 can rotate about a point axis formed by the pin 196. The degree of rotation is limited by a top and a bottom surface of the rectangular opening 45. When the bars abut the top surface of the rectangular openings 45, the bars 30 are coaxial. When a downward force is applied to the bars 30, the bars 30 are limited by the bottom surface of the rectangular openings 45. When the bars 30 abut the bottom surface of the rectangular opening 45, the inner end of the bars 30 have lowered preferably about 4 inches.

The hinge 40 is preloaded with a spring for coaxially biasing the bars 30. Biased in this manner, when sufficient downward force is applied to the canopy 14, the hinge 40 rotates. The bars 30 and the roller tube 26 also rotate forcing the canopy 14 to form a "V" or "U" shaped valley or gully such that the weight drains from the canopy 14. The hinge 40 returns the bars 30, and therefore, the roller tube 26 and the canopy 14, to their original position once the force is sufficiently diminished. When in the original position, the canopy rod 18, and therefore the outer edge of the canopy 14, is at, or near, a position substantially parallel to the ground.

The amount of force needed to sufficiently lower an edge of the canopy 14 so that some of the water is removed from the canopy is called the "predetermined load". The predetermined load is preferably 2 to 3 gallons of water or 16.7 to 25.0 pounds of water collect on the canopy 14. However, the predetermined load can vary depending on the canopy 14 size and type of the awning assembly 10. When the weight of the collected water is equal to, or greater than, the predetermined load, the awning assembly 10 is loaded. When loaded, at least one edge of the canopy 14 automatically lowers to drain at least some of the collected water from the canopy 14. When collected water is less than the predetermined load, the awning assembly 10 is unloaded and in the original position. The awning assembly 10 is in the original position when collected water does not drain from the canopy 14.

Alternatively, the roller bar 30 and/or also the roller tube 26 can be made wholly or partially of a resilient flexible material which deflects into an "U" shape when the awning assembly 10 is loaded. For example, the midsection of the roller bar 30 can be made of metal, rubber, plastic or fiberglass. Energy stored in the resilient material returns the bar 30 and the roller tube 26 to their original position when unloaded.

The bars 30 of the roller assembly 24 are supported by the arm assemblies 16. The left and right arm assemblies 16 have essentially identical structures, and therefore, only one will be described in detail hereinafter.

Figure 5:
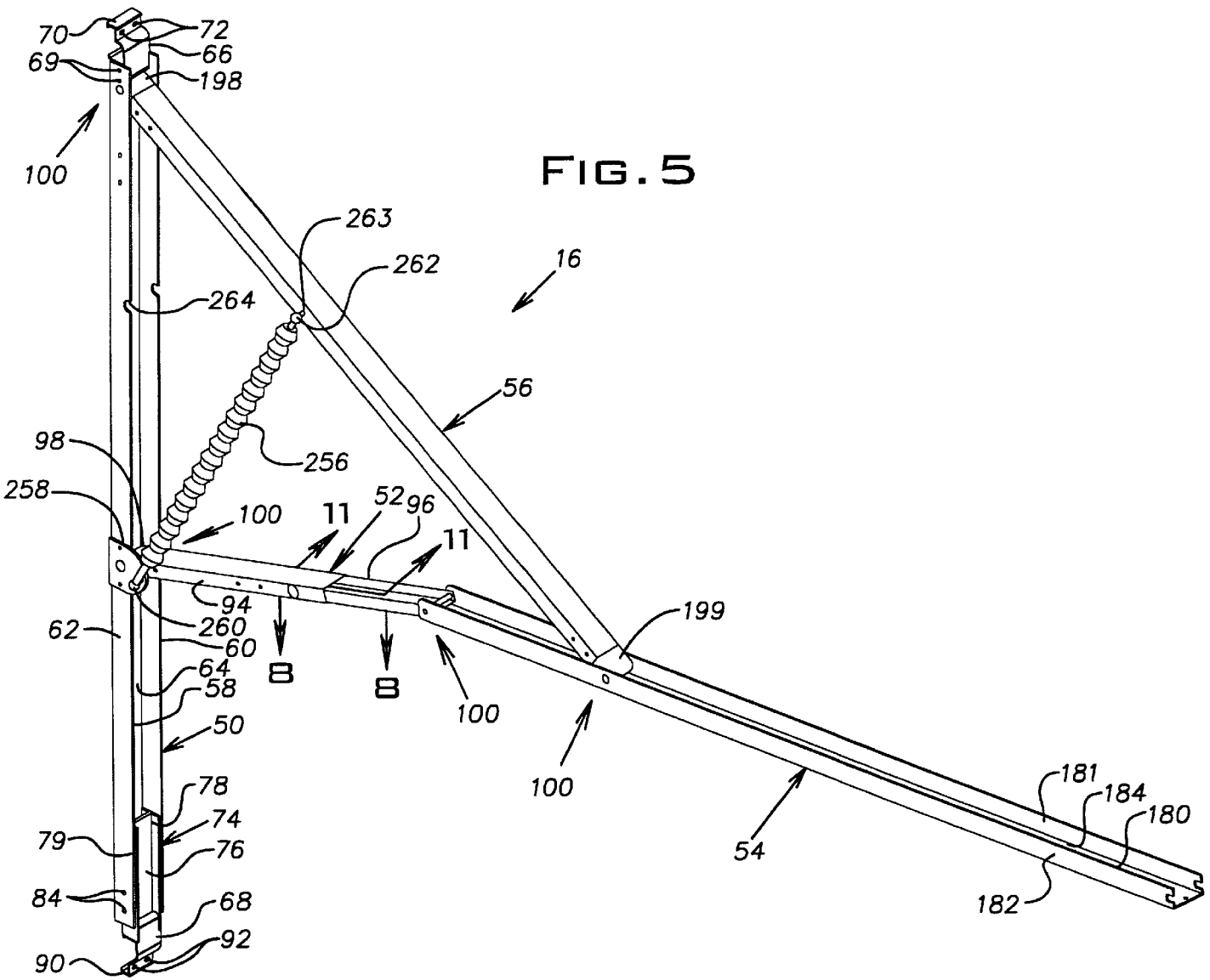
FIG. 5 is an enlarged perspective view of an arm assembly of the rain dump structure with a retracting bottom arm.
Figure 6:
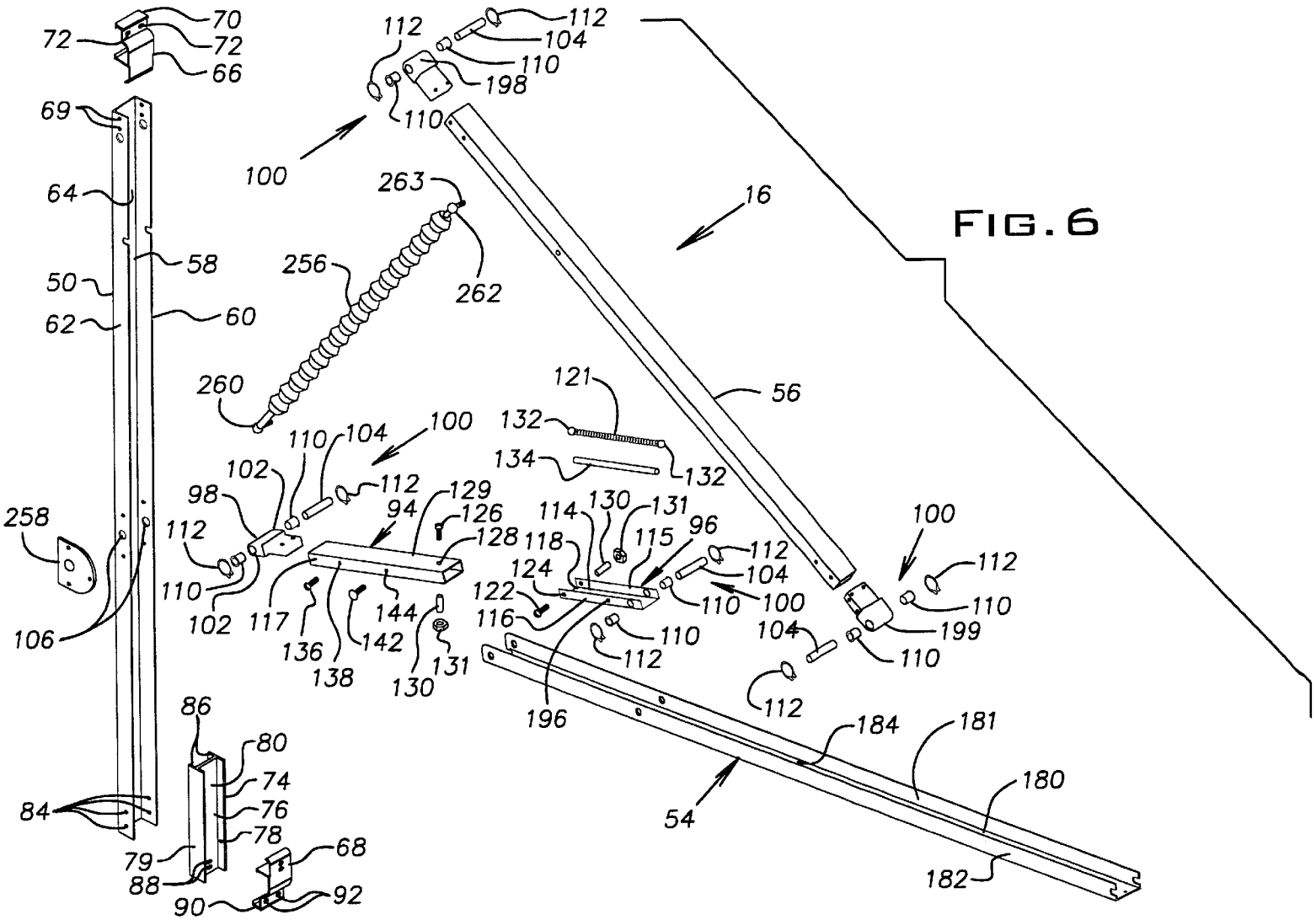
FIG. 6 is an exploded view of the arm assembly of FIG. 5.

As shown in FIGS. 5 and 6, each arm assembly 16 is a four bar linkage including a base arm 50, a bottom arm 52, a extended arm 54, and a top arm 56. Each arm assembly 16 is disposed in a generally vertical plane at an associated side edge of the canopy 14 and at an associated end of the canopy rod 18. Each of the arms 50, 52, 54, 56 is substantially straight and elongate. The arms 50, 52, 54, 56 are preferably extrusions of a light weight, high strength material such as an aluminum alloy.

The base arm 50 has a main wall 58 and inner and outer side walls 60, 62 which perpendicularly extend from opposed side edges of the main 58 wall to form a vertically extending and outward facing channel 64. The channel 64 is outward facing so that it at least partially receives the top and bottom arms 56, 52 when in the retracted position.

The base arm 50 is rigidly secured to the support wall 12, preferably with top and bottom mounting brackets 66, 68. The mounting brackets 66, 68 are preferably extrusions of a light weight, high strength material such as an aluminum alloy.

The top mounting bracket 66 extends from the open upper end of the base arm 50. At the upper end of the base arm 50, the side walls 60, 62 are provided with openings 69 for cooperating with threaded fasteners to rigidly attach the top mounting bracket 66 to the base arm 50. The top mounting bracket 66 is preferably formed for receiving the threaded fasteners. The top mounting bracket 66 has an inwardly extending top flange 70 at an upper end thereof which can be advantageously located at a top rail of a recreational vehicle when the awning assembly 10 is mounted thereto. The top mounting bracket 66 is also provided with openings 72 below the top flange 70 for cooperating with threaded fasteners to rigidly secure the top mounting bracket 66 to the support wall 12.

The lower end of the base arm 50 is preferably provided with a base arm extension 74. The base arm extension 74 is substantially straight and elongate and is fixed in length. The base arm extension 74 cooperates with the base arm 50 so that the distance between the top and bottom mounting brackets 66, 68 which is the effective length of the base arm 50, is variable as described in more detail hereinafter. The base arm extension 74 is preferably an extrusion of a light weight, high strength material such as an aluminum alloy.

The base arm extension 74 preferably has a generally H-spaced cross-section formed by a main wall 76 and an inner and outer side walls 78, 79 which perpendicularly extend from ends of the main wall 76. The base arm extension 74 is sized to fit within the channel 64 of the base arm 50 so that it can longitudinally move therein in a telescoping manner. Outwardly directed protrusions are provided at the base of the side walls 78, 79 which longitudinally extend along the length of the base arm extrusion 74. The protrusions are sized and shaped to cooperate with the undercuts or grooves formed in the side walls 78, 79 of the base arm 50 to interlock the base arm 50 and the base arm extrusion 74 together. Secured in this manner, the base arm 50 and the base arm extension 74 are interlocked together in a drawer-like manner such that they can only move longitudinally relative to one another.

At the lower end of the base arm 50, the side walls 60, 62 are provided with openings 84 for cooperating with threaded fasteners to rigidly attach the base arm extension 74 to the base arm 50. The side walls 78, 79 of the base arm extension 74 are preferably provided with inwardly directed flanges 86 which longitudinally extend along the length of the base arm extension 74. The flanges 86 are inwardly spaced apart from the main wall 76 to receive and secure the threaded fasteners therebetween. The side walls 78, 79 of the base arm extension 74 can be provided with a plurality of longitudinally spaced-apart openings so that the position of base arm extension relative to the base arm 50 can be adjusted to a plurality of positions. For example, there can be about six openings spaced-apart along intervals of about 1 to about 1.5 inches.

The bottom mounting bracket 68 extends from the lower end of the base arm extension 74. At the lower end of the base arm extension 74, the main wall 76 is provided with openings 88 for cooperating threaded fasteners to rigidly attach the bottom mounting bracket 68 to the base arm extension 74. The bottom mounting bracket 68 is preferably formed for receiving the threaded fasteners. The bottom mounting bracket 68 also has upwardly directed protrusion sized and shaped to cooperate with the main wall 76 and flanges 86 of the base arm extension 74. The protrusion extends between the main wall 76 and the flanges 86 to interlock the bottom mounting bracket 68 and the base arm extension 74. The bottom mounting bracket 68 has an inwardly extending bottom flange or hook member 90 at a lower end thereof which can be advantageously located at the box iron of a recreational vehicle when the awning assembly 10 is mounted thereto. The bottom mounting bracket 68 is also provided with openings 92 for cooperating with threaded fasteners to rigidly secure the bottom mounting bracket 68 to the support wall 12.

It can be seen from the above description that the overall length of the base arm extension 74 can be easily adjusted in a telescoping manner. Therefore, the awning assembly 10 can be easily secured to support walls 12 having various dimensions such as a variety of different recreational vehicles.

Figure 7:
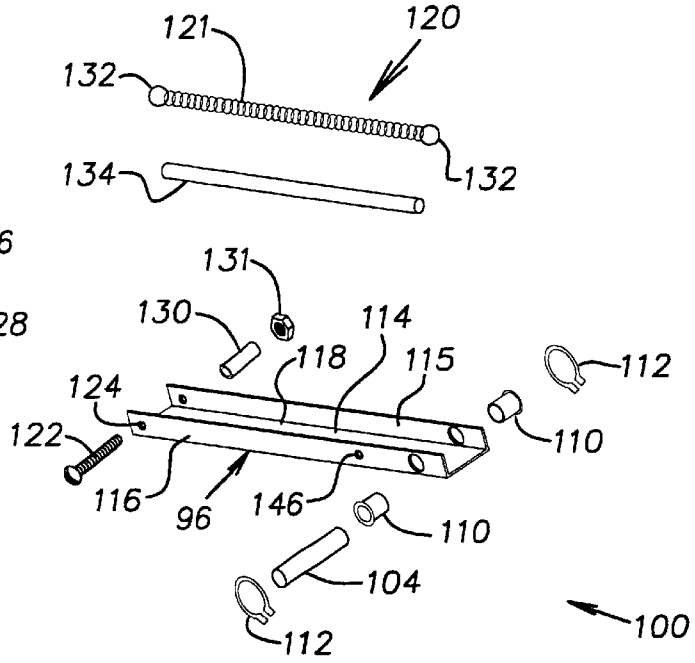
FIG. 7 is an exploded view of a first and second member of FIG. 6 showing a tension spring as a spring assembly.
Figure 7:
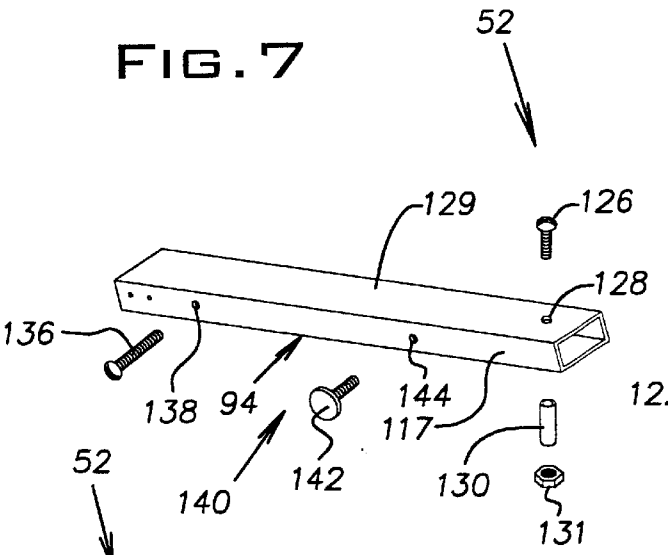
Figure 8:
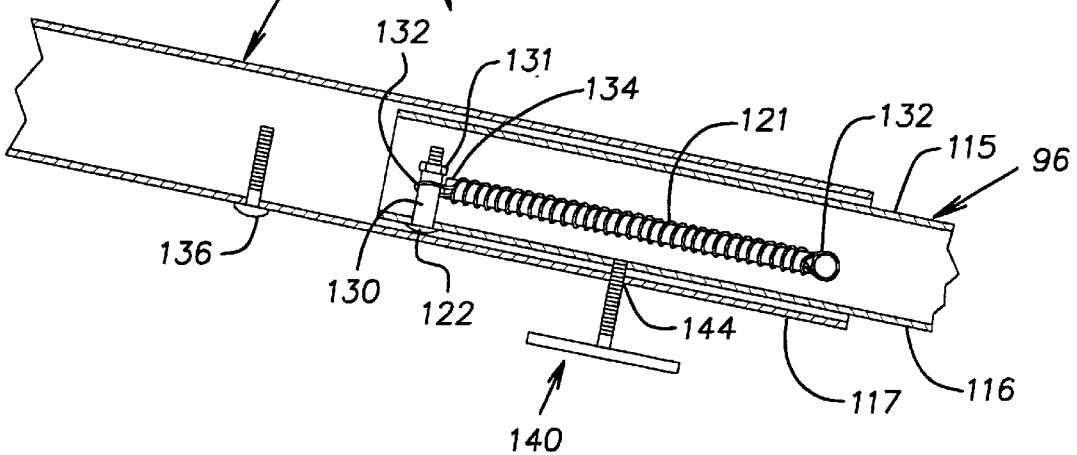
FIG. 8 is an enlarged fragmented view, in cross-section taken along line 8—8 of FIG. 5, showing a tension spring as the spring assembly.

As shown in FIGS. 6, 7 and 8, the bottom arm 52 has a first member 94 and a second member 96 slidably connected. The first member 94 of the bottom arm 52 has an inner end pivotally mounted to a central or intermediate portion of the base arm 50. The first member 94 is preferably tubular in cross-section and is provided with a plug or end cap 98 secured to and closing the open inner end of the first member 94. The end cap 98 is secured to the first member 94 in any suitable manner such as, for example, rivets or screws. The end cap 98 is rotatably connected to the base arm 50 with a pivot assembly 100 as hereinafter described.

The end cap 98 is provided with an opening 102 for receiving a pivot shaft 104 therethrough. The pivot shaft 104 extends through the end cap 98 and openings 106 in inner and outer side walls 60, 62 of the base arm 50 to form a pivot joint or rotatable connection therebetween. The pivot shaft 104 is preferably provided with suitable bearings 110, such as the illustrated flange sleeve bearing, and is preferably held in position by retaining rings 112. The end cap 98 is optionally biased to a central position within the channel 64 of the base arm 50 by spring washers located between the side walls 60, 62 of the base arm and flanges of the bearings 110.

The outer end of the first member 94 is open for slidably receiving the second member 96. The second member 96 is sized to fit within the tubular first member 94 so that it can longitudinally move therein in a telescoping manner. The second member 96 preferably has a main wall 114 and inner and outer side walls 115, 116 which perpendicularly extend from opposed side edges of the main wall 114 to form a vertically extending channel 118.

A elastic assembly 120 is disposed within the channel 118 of the second member 96. The elastic assembly 120 preferably is a tension spring 121. The proximal end of the tension spring 121 is located closer to the wall 12 than the distal end when the awning assembly 10 is in the extended position. The proximal end of the tension spring 121 is secured to a threaded fastener 122 which extends, through an opening 124 provided in either side wall 115, 116 of the second member 96, into the channel 118. The distal end of the tension spring 121 is secured to a threaded fastener 126 which extends, through an opening 128 provided in a top wall 129 of the first member 94, into the channel 118. The portion of the threaded fasteners 122, 126 which extend into the channel 118 preferably have a sleeve 130. A loop 132 is provided on each end of the tension spring 121 for connection to the sleeves 130 in any suitable manner. A nut 131 is tightened on the threaded fastener 122, 126 to secure the sleeves 130.

A rod 134 is disposed within the tension spring 121. The rod 134 is rigid, substantially straight, elongate and fixed in length. The rod 134 is preferably slightly longer than the length over coil of the tension spring 121 to maintain the tension spring 121 in a linear position. Additionally, the rod 134 can be sized to abut the threaded fasteners 122, 126 before the tension spring 121 is fully compacted. In this manner each threaded member 122, 126 is a stop surface against the respective end of the rod 134.

The first member 94 of the bottom arm 52 is provided with a rigidly attached stop piece 136. The stop piece 136 preferably is a threaded member and extends through an opening 138 in a side 117 of the first member 94 into the tubular interior of the first member 94. Other acceptable devices can be used as a stop piece such as a detent or lip. The stop piece 136 is disposed near the inner end of the first member 94. When the awning assembly 10 is unloaded, an inner end of the second member 96 is disposed in the central or intermediate portion of the first member 94. The distance between the stop piece 136 and the inner end of the second member 96 preferably is about 4 inches, however, other distances can be used. When loaded, the second member 96 moves within the first member 94 in a telescoping manner up to engaging the stop piece 136.

An internal latch or suitable lock mechanism 140 is provided to allow the bottom arm 52 to be secured in the unloaded position. Preferably only one bottom arm 52 is locked to allow operator choice in directing the drainage of collected water. For example, as illustrated, a threaded dial 142 can extend through an opening 144 provided in the outer side wall 117 of the first member 94. By turning the dial 142 clockwise, the dial 142 advances into the interior of the first member 94 and into an opening 146 provided in the second member 96. Additionally, a plurality of openings can be provided and/or the opening 146 can be oversized to provide sufficient clearance to assist in aligning the threaded dial 142 with the opening 146 in the second member 96.

It can be seen from the above description that when the awning assembly 10 is loaded, the second member 96 of the unlocked bottom arm 52 slides into the first member 94, thereby shortening the effective length of the bottom arm 52. The end of the canopy rod 18 and, therefore, the outer end of the canopy 14, slope downward towards the arm assembly 16 with the shortened bottom arm 52. Water collected on the canopy 14, assisted by gravity, migrates toward the lowered corner of the canopy 14 and drains therefrom. When the awning assembly 10 returns to the unloaded state, energy stored in the tension spring 121 automatically lengthens the bottom arm 52 thereby restoring the canopy rod 18 and the canopy 14 to the original position.

As shown in FIG. 9, an alternative elastic assembly 120A includes a compression spring 148. The compression spring 148 is located between the first member 94 and the second member 96. A dividing wall 150 is provided in the first member 94. The dividing wall 94 has a planar outer surface and is sized to closely fit within the tubular cross-section of the first member 94. The dividing wall 150 is integral to the first member 94, or is fixedly secure thereto by any suitable manner such as, for example, rivets or screws. The dividing wall 150 preferably is an extrusion of light weight, high strength material such as aluminum alloy.

The inner end of the second member 96 has an end wall 152. The end wall 152 can be integral to the second member 96, or fixedly secured thereto by any suitable manner such as, for example, rivets or screws. The end wall 152 has a planar inner surface. The end wall 152 preferably is an extrusion of light weight, high strength material such as aluminum alloy.

The outer surface of the dividing wall 150 faces the end wall 152 and is provided with a spring guide 154. The spring guide 154 can be fixedly attached in any known manner to the dividing wall 150, or rest thereon. The spring guide 154 preferably has a vertically extending, elongate, center rod 156 fixedly attached in any known manner. The spring guide 154 and the center rod 156 are rigid and preferably are extrusions of a light weight, high strength material such as an aluminum alloy. The compression spring 148 rests on the spring guide 154 and is disposed around the center rod 156. The center rod 156 is preferably slightly longer than the aggregate wire diameters of the compression spring 148. The compression spring 148 has a proximal end abutting the outer surface of the dividing wall 150 and a distal end abutting the inner surface of the end wall 152.

A suitable lock mechanism 140 is provided to allow the bottom arm 52A to be secured in the unloaded position. When the awning assembly 10 is loaded, the unlocked second member 96 telescopically moves further into the first member 94, thereby shortening the effective length of the unlocked bottom arm 52A. The minimum effective length the bottom arm 52A can obtain occurs when the end wall 152 engages center rod 156.

As shown in FIGS. 10 and 11, the elastic assembly 120B is a rack and pinion assembly 158 that can be used between the first member 94 and the second member 96 to allow the effective length of the bottom arm 52B to decrease when the awning assembly 10 is loaded and return to original length when unloaded.

The second member 96 is provided with a rack 160. The rack 160 is integral or fixedly attached to either side wall 115, 116 of the second member 96. The rack 160 has teeth 162 which extend several inches along the side wall 115 or 116 and face into the channel 118.

The top of the first member 94 is provided with an opening for cooperating with a shaft 166 to rotatably attach a pinion 168. The pinion 168 is disposed within the channel 118 of the second member 96. The shaft 166 extends into the channel 118 where the pinion 168 has an opening for receiving the shaft 166. The pinion 168 rotates about the central axis 170 of the shaft 166 and is mounted thereto in any known manner. The pinion 168 is provided with a torsion spring 172.

The torsion spring 172 is disposed about the shaft 166. One end of the torsion spring 172 is secured to the shaft 166 or to the top wall 129 of the first member 94 and the other end of the torsion spring 172 is secured to the pinion 168. Both ends of the torsion spring 172 are secured in any suitable manner.

The pinion 168 has a disk like shape with teeth 174 around the circumference. The teeth 174 of the pinion 168 and the teeth 162 of the rack 160 cooperate to engage as a gear over the entire distance in which the first member 94 and second member 96 can move in relation to each other.

A suitable lock mechanism 140 is provided to allow the bottom arm 52A to be secured in the unloaded position. When the awning assembly 10 is loaded, the unlocked second member 96 slidably moves further into the first member 94 in a telescoping manner, thereby reducing the effective length of the bottom arm 52B. This movement causes the teeth 162 of the rack 160 the teeth 174 of the pinion 168 to cooperate to rotate the pinion 168. The rotation of the pinion 168 causes the torsion spring 172 to flex by twisting about the central axis 170 thereby increasing force which opposes further inward movement of the second member 96.

A rigidly attached stop piece 178 provided in the first member 94 limits the distance the second member 96 can telescopingly move into the first member 94. The stop piece 178 preferably is a threaded member and extends through an opening in either side wall 115, 116 of the first member 94 into the tubular interior of the first member 94. Other acceptable devices can be used as a stop piece such as a detent or lip. The stop piece 178 is preferably disposed about 4 inches closer than the inner end of the second member 96 is to the inner end of the first member 94.

Other configurations of elastic assemblies 120 can be utilized within the scope of the present invention. For example, the elastic assembly 120 can utilize both a tension and a compression spring. A further example of a suitable elastic assembly 120 is a gas spring. Still further, rollers can be disposed between side walls 107, 108 of the first member 94 and the side walls 115, 116 of the second member 96. For example, springs are provided with one end securely attached to the roller and the other end securely attached to the second member 96.

Still further, a suitable elastic assembly 120 can include a sleeve, containing a spring, fixedly mounted on the exterior of the first member 94. A handle, slidably mounted in a track on the first member 94 engages the spring. The first member 94 has a slotted opening which runs the length of the track, preferably 4 inches. The handle is provided with a pin which inserts through the slotted opening and into an opening provided in a side of the second member 96. The pin is stationary within the second member 96. When the awning assembly 10 is loaded, the second member 96 slidably moves further into the first member 94. Since the pin moves with the second member 96 and the handle with the first member 94, the handle acts against the spring. Once unloaded, energy stored in the spring returns the first and second member 94, 96 to their original positions.

As shown in FIGS. 5 and 6, the extended arm 54 has an inner or lower end pivotally mounted to an outer end of the second member 96 with a pivot assembly 100 and an outer end connected to the end of the roller assembly 24. The extended arm 54 is preferably channel-shaped in cross-section having a main wall 180 and inner and outer side walls 181, 182 perpendicularly extending from opposed side edges of the main wall 180 to form a channel 184. The channel 184 preferably faces upward when the awning assembly 10 is extended so that it at least partially receives the bottom arm 52 therein when in the retracted or stored position.

As shown in FIG. 2, the upper end of the extended arm 54 supports the roller assembly 24. The upper end of the extended arm 54 is provided with an upper end cap 186 which has a socket into which the upper end of the extended arm 54 is closely received and rigidly secured. The upper end cap 186 is preferably secured to the extended arm 54 by rivets, but can be alternatively secured in other manners.

The upper end cap 186 and the roller bar 30 are preferably secured together in a manner which allows rotation of the bar 30, relative to the upper end cap 186, about only one axis which facilitates handling the misalignment. The bar 30 cannot rotate about the rotational axis 36 or the longitudinal axis 192 of the extended arm 54. The bar 30 can, however, rotate about the pivot axis which is substantially perpendicular to both the rotational axis 36 and the longitudinal axis 192 of the extended arm 54 at the upper end of the extended arm 54. In the illustrated embodiment the pivot axis is formed by a pin 196 which extends through the bar 30 and the upper end cap 186. The bar 30 and the upper end cap 186, however, can be alternatively joined in other suitable manners such as, for example, by a screw or tube rivet.

As shown in FIGS. 5 and 6, the top arm 56 has an inner or upper end pivotally mounted to an upper portion of the base arm 50 with a pivot assembly 100 and an outer or lower end pivotally mounted to an intermediate portion of the extended arm 54 generally near the lower or inner end of the extended arm 54 with a pivot assembly 100. The top arm 56 is preferably tubular in cross-section and preferably has inner and outer end caps 198, 199 secured to and closing the open inner and outer ends of the top arm 56 respectively.

This system of pivotally attached bars or arms 50, 52, 54, 56 form a four-bar linkage that provides the arm assemblies 16 which reaches out to support the canopy rod 18 and folds back into a compact stack against the wall 12, by stacking the tubular-shaped arms 52, 56 within the channel-shaped arms 50, 54.

Figures 12, 13, 14:
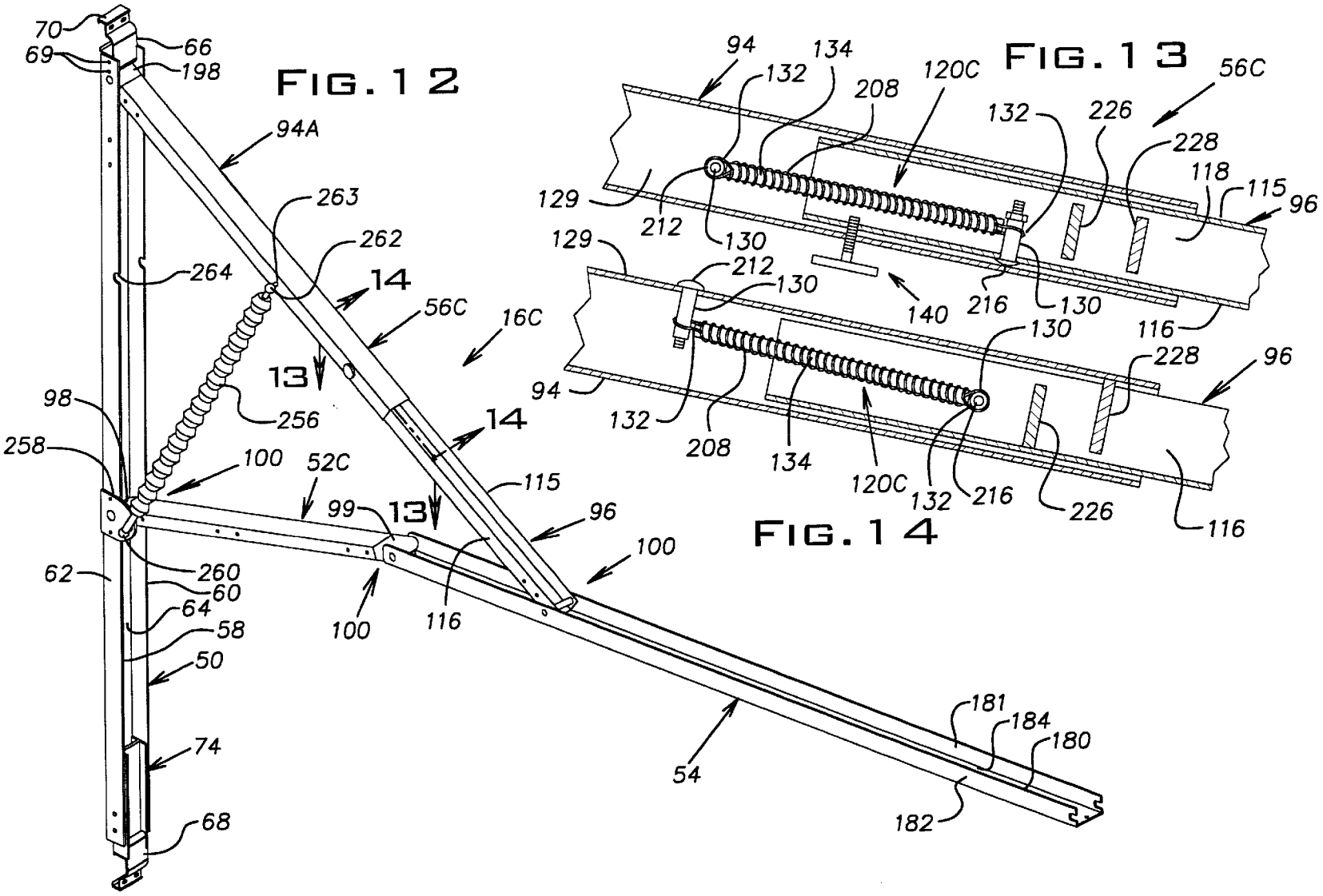
FIG. 12 is an enlarged perspective view of an arm assembly of the rain dump structure with an elongating top arm.
FIG. 13 is an enlarged fragmented view, in cross-section taken along line 13—13 of FIG. 12, of the top arm.
FIG. 14 is an enlarged fragmented view, in cross-section taken along line 14—14 of FIG. 12, of the top arm.

In an alternative arm assembly 16C shown by FIGS. 12 to 14, a bottom arm 52C is fixed in length, while the effective length of a top arm 56C lengthens when the awning assembly 10 is loaded. The inner and outer ends of the bottom arm 52C are provided with end caps 98, 99. The inner end of the bottom arm 52C is pivotally attached to an intermediate portion of the base arm 50 with a pivot assembly 100. The outer end of the bottom arm 52C is pivotally attached to an inner end of the extended arm 54 with a pivot assembly 100.

The top arm 56C includes a first member 94 and a second member 96 with an elastic assemblies 120C similar, except as described below, to those previously described for the bottom arm 52. The inner end of the first member is provided with an end cap 190 and is pivotally attached to the upper end of the base arm 50 with a pivot assembly 100. The outer end of the second member 94 is pivotally attached to an intermediate portion of the extended arm 54 with a pivot assembly.

As shown in FIGS. 13 and 14, the elastic assembly 120C is preferably an elongation spring 208. The elongation spring 208 is disposed within a channel 118 of the second member 96. A proximal end of the elongation spring 121 is located closer to the wall 12 than a distal end, when the awning assembly 10 is in the extended position. The proximal end of the elongation spring 208 is secured to a threaded fastener 212 which extends, though an opening provided in a top wall 129 of the first member 94, into a tubular cross-section of the first member 94. The distal end of the elongation spring 208 is secured to a threaded fastener 216 which extends, through an opening provided in either side wall 115, 116 of the second member 96, into the channel 118. Both threaded fasteners 212, 216 preferably have a sleeve 130 encircling a portion of the threaded fastener 212, 216 which extends into the channel 118. A loop 132 is provided on each end of the elongation spring for connection to the sleeves 130 in any suitable manner.

Preferably a rod 134 is disposed within the elongation spring 208. The rod 134 is rigid, substantially straight, elongate and fixed in length. The rod 134 is preferably slightly longer than the width of the aggregate coil diameters of the elongation spring 208 to maintain the elongation spring 208 in a linear position.

The top arm 56C is provided with two stop members 226, 228. The first stop member 226 is a detent extending from either side wall 115, 116 of the second member 96 into the channel 118. The first stop member 226 is rigidly attached to the second member 96 by any suitable manner, such as rivets or screws. The second stop member 228 preferably is a detent extending from the top of the first member 94 into the channel 118 of the second member 96. The second stop member 228 is rigidly attached to the first member 94 by any suitable manner, such as by rivets or screws. The first and the second stop members 226, 228 are preferably extrusions of a light weight, high strength material such as an aluminum alloy. Both stop members 226, 228 are sized and positioned so to not interfere or come into contact with the elongation spring 208. The first stop member 226 is preferably four inches closer, than the second stop member 228 is to the inner end of the top arm 56C.

A suitable lock mechanism 140 is provided on the top arm 56C to allow the top arm 56C to be secured in the unloaded position. When loaded, the force of gravity longitudinally moves the unlocked second member 96 further out of the first member 94 in a telescoping manner up to engaging the first and second stop members 226, 228. Since the top arm 56C is downward sloping, an end of the canopy rod 18 and, therefore, the outer end of the canopy 14, slope downward towards the lengthened top arm 56C. Water collected on the canopy 14, assisted by gravity, migrates toward the lowered corner of the canopy 14 and drains therefrom. Once the awning assembly 10 is unloaded, energy stored in the elongation spring 208 automatically shortens the top arm 56C thereby restoring the canopy rod 18 and the canopy 14 to the original position.

Figures 15, 16:
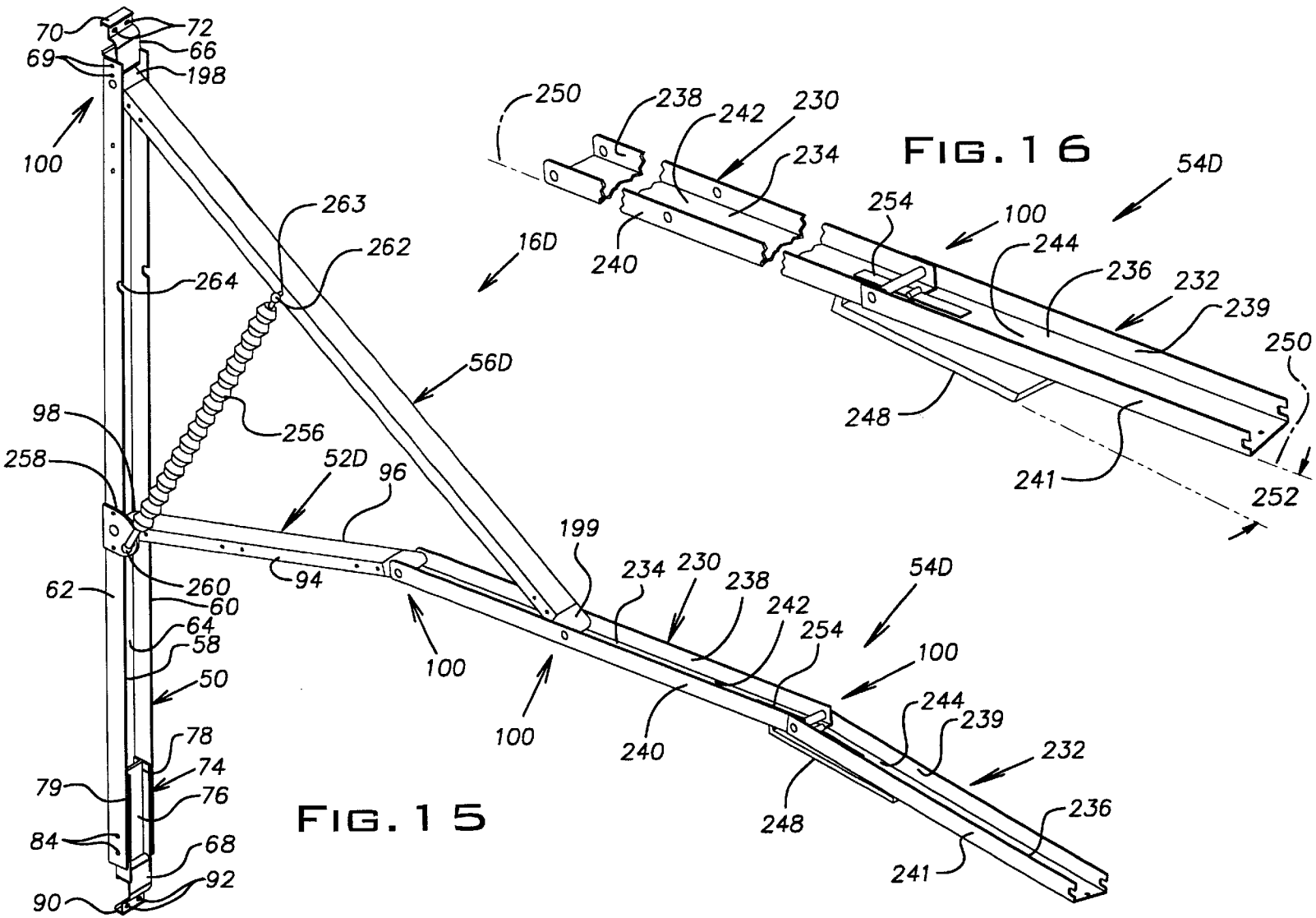
FIG. 15 is an enlarged perspective view of an arm assembly of the rain dump structure with a pivoting extended arm.
FIG. 16 is an enlarged perspective view of the extended arm of FIG. 15.

In another alternative, as illustrated in FIGS. 15 and 16, a top arm 56D and a bottom arm 52D of an arm assembly 16D are fixed in length, while an outer end of an extended arm 54D pivots downward when the awning assembly 10 is loaded.

The inner and outer ends of the top and bottom arms 56D, 52D are provided with end caps 198, 98, 199, 99. The inner end of the top arm 56D is pivotally attached to the upper portion of the base arm 50 with a pivot assembly 100. The inner end of the bottom arm 52D is pivotally attached to an intermediate portion of the base arm 50 with a pivot assembly 100. The outer end of the top arm 56D is pivotally attached to an intermediate portion of the extended arm 54D with a pivot assembly 100. The outer end of the bottom arm 52D is pivotally attached to an inner end of the extended arm 54D with a pivot assembly 100.

The extended arm 54D has a first and second section 230, 232. The first and the second sections 230, 232 have a main wall 234, 236 and inner and outer side walls 238, 239, 240, 241 which perpendicularly extend to from vertically extending channels 242, 244. The channels 242, 244 face upwards when the extended arm 54D is in the deployed position.

The inner end of the first section 230 is pivotally connected to the bottom arm 52D with a pivot assembly 100. The outer end of the first section 230 is pivotally connected to the inner end of the second section 232 with a pivot assembly 100.

The outer edge of the first section 230 is provided with a stop member 248. The stop member 248 is fixedly secured to the bottom of the main wall 234 in any known manner. The stop member 248 is rigid and is preferably an extrusion of a light weight, high strength material such as an aluminum alloy. The stop member 248 extends preferably about six inches beyond the outer edge of the first section 230. The stop member 248 forms a downward acute angle 252 with the longitudinal axis 250 of the first section 230. The angle 252 is set so that when second section 252 engages the stop member 248, the outer end of the second section 232 has lowered preferably about 4 inches.

A joint 254 connects the first section 230 with the second section 232. The joint 254 can be of any suitable mechanism such as, for example, a hinge or a ball in socket. The joint 254 is secured to the top of the main wall 234, 236 of the first and second sections 230, 232 to allow the second section 232 to rotate downwards. The joint 254 is preloaded with a spring for biasing the first and second section 230, 232 to a coaxial relationship. Biased in this manner, when the predetermined load is applied to the canopy 14, the joint 254 and the second section 232 rotate downward. When the awning assembly 10 is unloaded, energy stored in the spring automatically restores the joint 254 and the second section 232 to their original position.

The extended arm 54 is provided with a suitable lock mechanism for selectively preventing rotation of the second section 232.

Figure 17:
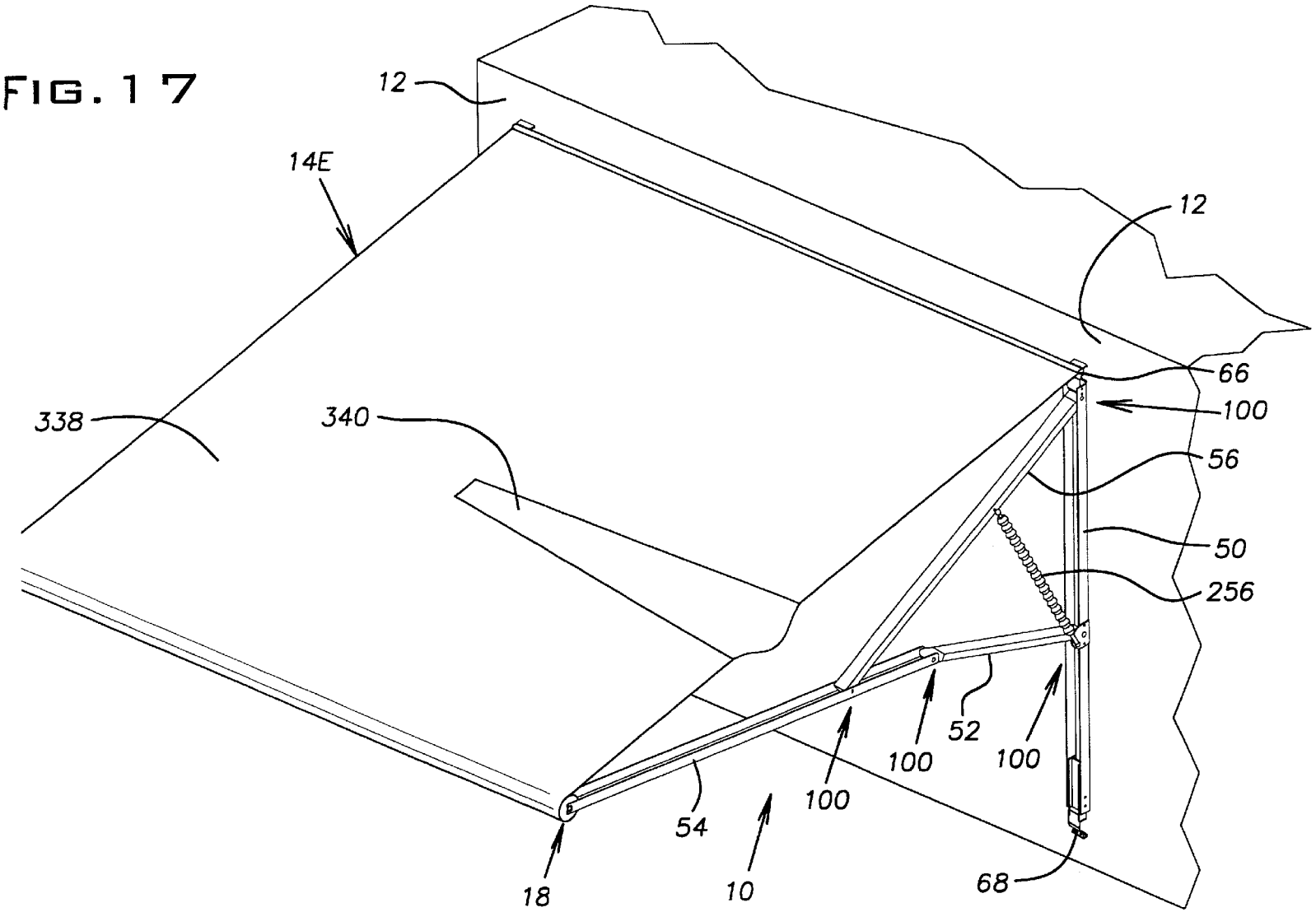
FIG. 17 is an enlarged perspective view of an awning assembly for the rain dump structure with a canopy having a highly elastic section.

FIG. 17 illustrates another alternative of the awning assembly 10 wherein a canopy 14E has a main section 338 and an elastic section 340 made of materials having different elasticity. The main section 338 is made of a flexible material such as, for example, fabric, canvas, acrylic or nylon. The elastic section 340 is made of a highly elastic material such as, for example, fabric, acrylic or nylon.

The elastic section 340 is sized and positioned to drain collected water from the canopy 14E when the awning assembly 10 is loaded. For example, the illustrated elastic section 340 is shaped as a isosceles trapezoid with an inner base near the middle of the canopy 14E, an outer base at either side edge of the canopy 14E. It is noted that the elastic section 340 can be of other shapes such as, for example, rectangular or triangular.

When the awning assembly 10 is loaded, the elastic section 340 automatically deforms downward more than the main section 338 thereby forming valley 342. Assisted by gravity, collected water drains through the valley 342 and off the canopy 14A. Thereafter, energy stored in the resilient elastic section 340 automatically restores the elastic section 340 to an original unreformed position.

Other configurations of arm assemblies 16 can be utilized within the scope of the present invention. For example, the extended arm 54, or a portion thereof, can be made a resilient flexible material. When the awning assembly 10 is unloaded, the extended arm 54 is substantially straight and elongate. When the awning assembly 10 is loaded, the extended arm 54 bows or deflects thereby lowering the outer end of the extended arm 54. Preferably, the outer end of the extended arm 54 is lowered about 4 inches when loaded.

As shown in FIG. 5 each arm assembly 16 can also include a strut 256 for supporting the top arm 56 when the awning assembly 10 is in the deployed position. The strut 256 is preferably a gas strut. Both ends of the strut 256 are preferably provided with pivotable ball end joints 260, 262. The first end of the strut 256 is mounted to the base arm 50 by a lower mounting bracket 258. The lower mounting bracket 258 is secured to the outer side wall 62 of the base arm 50 at an intermediate portion thereof by any suitable manner such as, for example, rivets or screws. In the illustrated embodiment, the lower mounting bracket 258 is secured at the pivot assembly 100 between the base arm 50 and the bottom arm 52. The second end of the strut 256 is mounted to the top arm 56 at a central or intermediate portion thereof by any suitable manner such as, for example, a threaded stud 263 of the ball end joint 262. The outer side wall 62 of the base arm 50 is provided with a suitable cut-out or clearance 264 opening for the ball end joint 262 when in the retracted position.

The strut 256 is positioned and sized to act in concert with the elastic assembly 120 to apply force against the awning assembly 10 and water collected on the canopy 14. The combined force provided by the strut 256 and the elastic assembly 120 hold the awning assembly 10 at the original position until the awning assembly 10 is loaded. When the awning assembly 10 is loaded, the strut 256 and the elastic assembly 120 permit a corner of the awning assembly 10 to lower. Conversely, when the awning assembly 10, previously loaded, becomes unloaded, the force of the strut 256 and the elastic assembly 120 return the awning assembly 10 to the original position.

The awning assembly 10 can also include a manual or automatic extension and retraction mechanism to deploy and retract the awning assembly 10. The extension and retraction mechanism can be of any suitable type. See, for example, application Ser. No. 09/519,779 filed Mar. 7, 2000, disclosing a suitable extension and retraction mechanism which is herein incorporated by reference.

Figure 18:
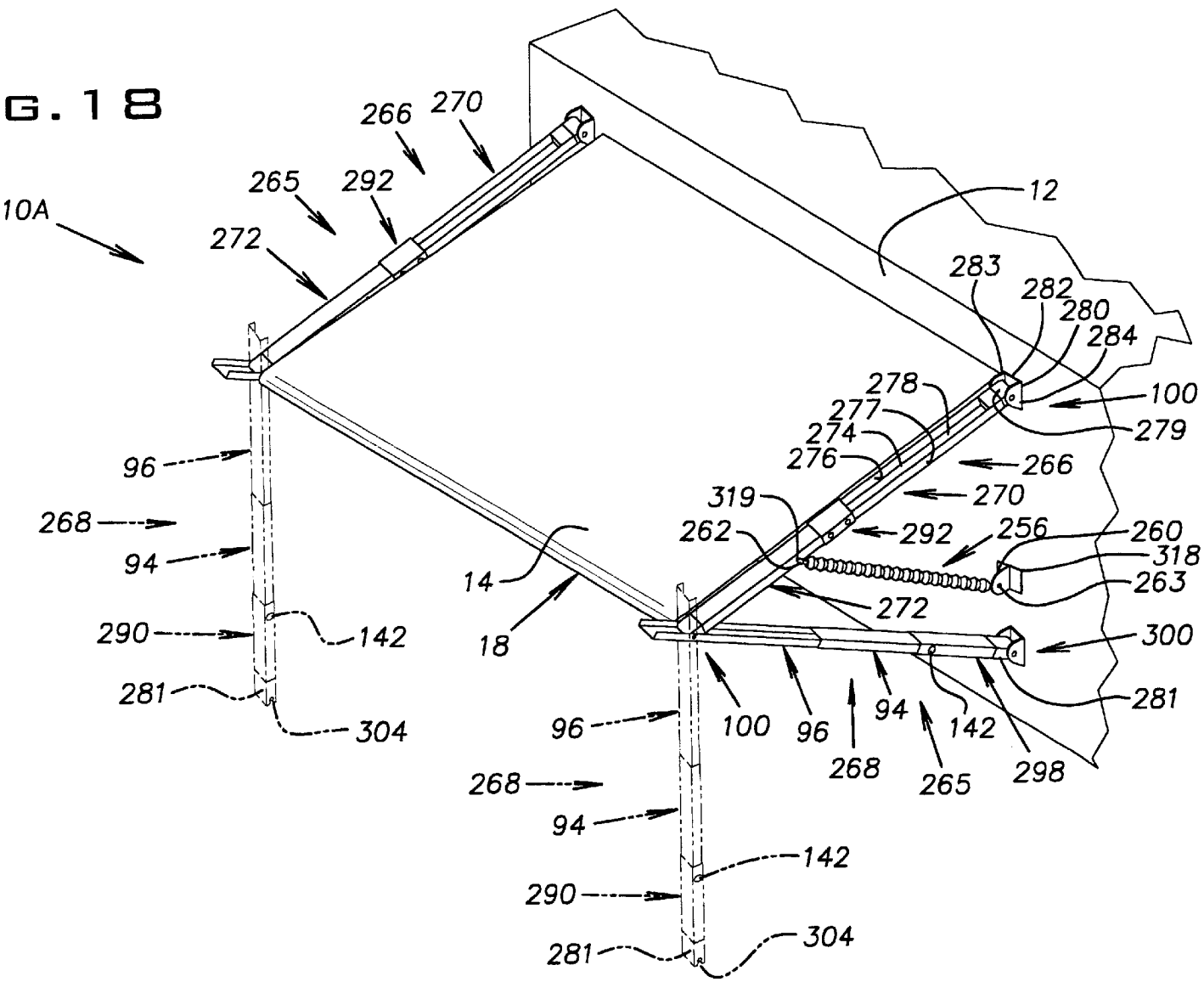
FIG. 18 is an enlarged perspective view of a another embodiment of an awning assembly for a rain dump structure.

FIG. 18 illustrates a different embodiment of an awning assembly 10A according to the present invention wherein like reference numbers are used for like structure previously described. The awning assembly 10A is similar to the awning assembly 10 previously described, except that each arm assembly 265 includes a rafter arm 266 and a support arm 268 instead of the four bar mechanism.

Each arm assembly 265 is disposed in a generally vertical plane at an associated side edge of the canopy 14 and at an associated end of the canopy rod 18. Each of the arms 266, 268 can be arcuate and elongate, or can be substantially straight and elongate as illustrated in FIG. 18. The arms are preferably extrusions of a light weight, high strength material such as an aluminum alloy. The left and right arm assemblies 265 have essentially identical structures, and therefore, only one will be described in detail hereinafter.

The rafter arm 266 has a first and second section 270, 272 which cooperate to form the total length of the rafter arm 266. The first section 270 has a main wall 274 and inner and outer side walls 276, 277 which perpendicularly extend from opposed side edges of the main wall 274 to from a vertically extending and upward facing channel 278. The channel 278 is upward facing so that it at least partially receives the second section 272 when the awning assembly 10A is in the retracted position. The first section 270 has an inner end pivotally connected to an upper mounting bracket 280 with a pivot assembly 100. The inner end of the first section 270 is provided with an end cap 279. The end cap 279 is secured to the first section 270 in any suitable manner such as, for example, rivets and screws.

Figure 19:
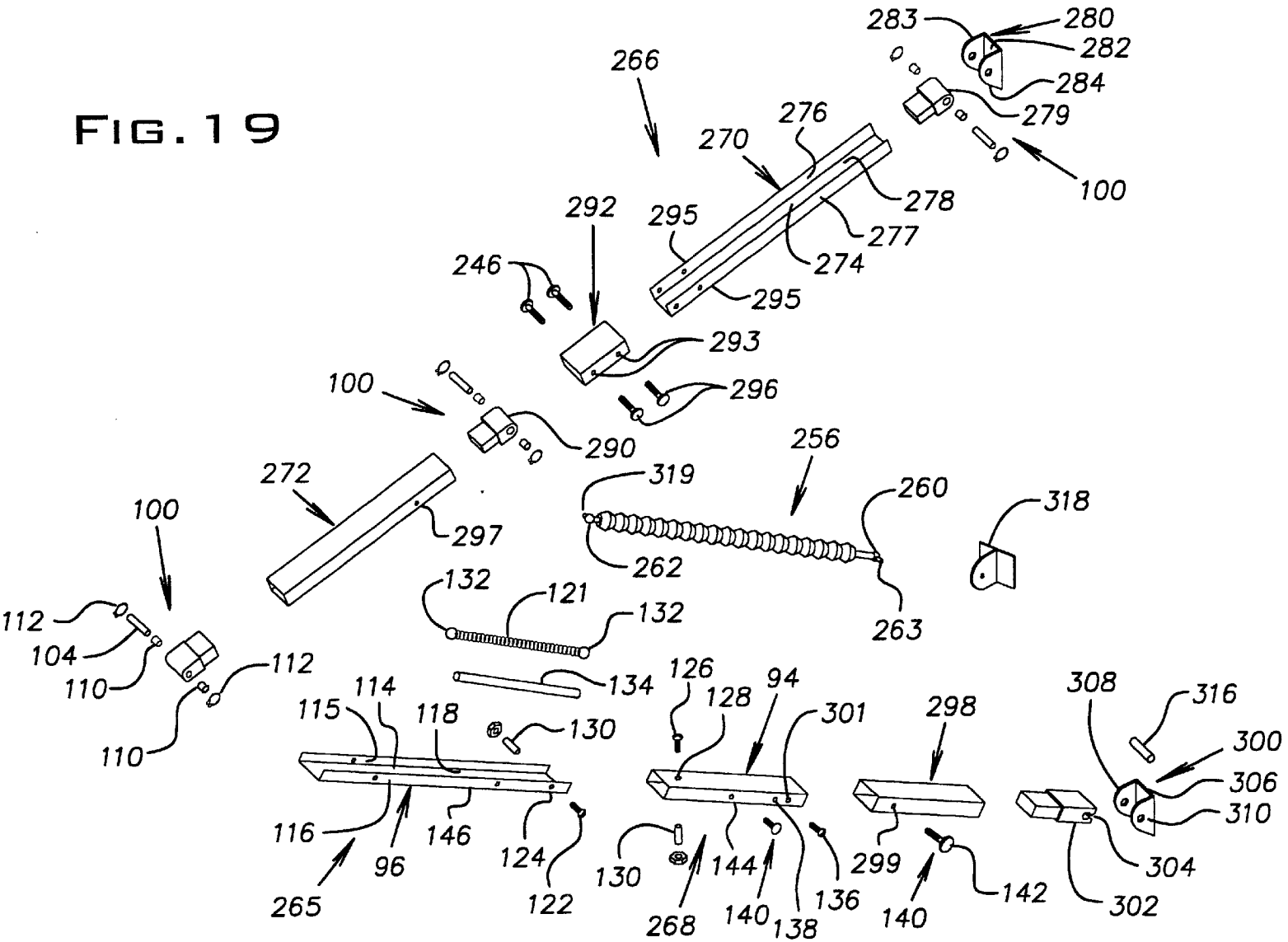
FIG. 19 is an exploded view of an arm assembly of FIG. 18.

As shown in FIG. 19, the upper mounting bracket 280 has a main wall 282 and inner and outer side walls 283, 284 which perpendicularly extend from opposed side edges of the main wall 282 to form a vertically extending and outward facing channel. The channel is outward facing so that it at least partially receives the end cap 279 of the first section 270. The upper mounting bracket 280 is preferably an extrusion of a light weight, high strength material such as an aluminum alloy. The upper mounting bracket 280 is rigidly secured to the support wall 12. The main wall 282 of the upper mounting bracket 280 is provided with openings for cooperating with threaded fasteners to rigidly attach the upper mounting bracket 28 to the support wall 12. The support wall 12 is provided with openings for receiving the threaded fasteners.

The second section 272 has an inner end pivotally connected to the outer end of the first member 270 with a pivot assembly 100. The second section 272 is tubular in cross-section. The inner end of the second section 272 is provided with an end cap 290 secured to and closing the open inner end of the second section 272. The end cap 290 is secured to the second section 272 in any suitable manner such as, for example, rivets or screws.

A stabilizing sleeve 292 is slidably mounted on the rafter arm 266. The sleeve 292 is tubular in cross-section and sized to fit around the circumference of the rafter arm 266 so that it can longitudinally move thereon. The sleeve 292 is preferably about 12 inches in length. The sleeve 292 is preferably an extrusion of a light weight, high strength material such as an aluminum alloy.

The stabilizing sleeve 292 is provided with a suitable lock or locks to secure the stabilizing sleeve 292 in a fixed position when the awning assembly 10A is deployed. When the awning assembly 10A is deployed, the stabilizing sleeve 292 is slid to position equally straddling the first and second sections 270, 272 of the rafter arm 266. Thereafter, the locks are engaged securing the stabilizing sleeve 292 in a fixed position on the rafter arm 266. The stabilizing sleeve 292 prevents the pivot assembly 100 between the first section 270 and second section 272 from rotating, thereby making the rafter arm 266 substantially straight.

For example, in the illustrated embodiment, openings 293 are provided in the stabilizing sleeve 292 for cooperating with threaded dials 296 to rigidly secure the stabilizing sleeve 292 to the first and second sections 270, 272. The first and second sections 270, 272 are provided with openings 295, 297 which align with the openings 293 in the stabilizing sleeve 292 to receive the threaded dials 296.

Other configurations of the rafter arm 266 can be utilized within the scope of the present invention. For example, the rafter arm 266 can include a first member which longitudinally moves within a second member in a telescoping manner. Moreover, the rafter arm 266 can be provided with the elongation spring 208 as previously described in the top arm 56.

The second section 272 has an outer end pivotally connected near an upper or outer end of the support arm 268 with a pivot assembly 100. The support arm 268 has a bottom member 298, a first member 94 and a second member 96. The first and second members 94, 96 cooperate together and are as described in the first embodiment of the awning assembly 10. The bottom member 296 is substantially straight and elongate and is fixed in length.

As shown in FIG. 18, the outer end of the second member 96 supports the canopy rod 18. The canopy rod 18 preferably is a roller assembly 24. The free end of the second member 96 is provided with an end cap 186 which has a socket 188 into which the upper end of the second member 96 is closely received and rigidly secured. The end cap 186 is preferably secured to the second member 96 by rivets, but can be alternatively secured in other manners. The end cap 186 and the roller assembly 24 are secured together in the same manner as described in the first embodiment of the awning assembly 10.

As shown in FIG. 19 the inner end of the first member 94 is slidably connected to the outer end of the bottom member 298. The bottom member 298 is tubular in cross-section and is sized to fit around the circumference of the first member 94 so that the bottom member 298 can longitudinally move thereon in a telescoping manner.

A suitable lock mechanism 140 is provided to secure the bottom member 298 to the first member 94. For example, an opening 299 can be provided in the bottom member 298 for cooperating with a threaded dial 142 to rigidly secure the bottom member 298 to the first member 94. The first member 94 is provided with a plurality of openings 301 for receiving the threaded dial 142 so that the length of the support arm 268 can be adjusted to the proper height to deploy and store the awning assembly 10.

The inner end of the bottom member 298 is pivotally mounted to a lower mounting bracket 300. The inner end of the bottom member 298 is preferably provided with a notched end cap 302 secured to and closing the open inner end of the bottom member 298 in any suitable manner such as, for example, rivets or screws. The inner end of the notched end cap 302 is provided with an "U" shaped channel 304 which extends parallel to the support wall 12 across the width of the notched end cap 302. The "U" shaped channel 304 is sized to pivotally receive the lower mounting bracket 300.

The lower mounting bracket 300 has a main wall 306 and inner and outer side walls 308, 310 which perpendicularly extend from opposed side edges of the main wall 306 to form a vertically extending and outwardly facing channel. The lower mounting bracket 300 is rigidly secured to the support wall 12. The main wall 306 of the lower mounting bracket 300 is provided with openings for cooperating with threaded fasteners to rigidly attach the lower mounting bracket 300 to the support wall 12. The support wall 12 is provided with openings for receiving the threaded fasteners. The channel is outward facing so that it at least partially receives the end cap 281 of the first member 94. A rod 316 spans the channel and is fixedly secured to the inner and outer side walls 308, 310 in any suitable manner, such as for example, rivets or screws. The rod 316 is sized to slidably fit into the "U" shaped channel 304. The lower mounting bracket 300 and the rod 316 are preferably extrusions of a light weight, high strength material such as an aluminum alloy.

As shown by dashed lines in FIG. 18, the support arm 268 can also be removed from the rod 316 and placed directly on the ground.

A suitable lock mechanism 140 is provided to allow the first member 94 and the second member 96, and therefore the support arm 268, to be secured in the unloaded position.

Each arm assembly 265 can also include a strut 256 for supporting the rafter arm 266 when in the deployed position. The strut 256 is preferably a gas strut. The strut 256 is preferably provided with pivotable ball end joints 260, 262. A first end of the strut 256 is pivotally mounted to a middle mounting bracket 318. The middle mounting bracket 318 is secured to the support wall 12 at an intermediate level by any suitable manner such as, for example, rivets or screws. A second end of the strut 256 is mounted to the rafter arm 266 at a central or intermediate portion thereof. The first and second ends of the strut 256 are mounted by any suitable manner such as, for example, a threaded stud 263, 319 of the ball end joint 260, 262.

The strut 256 is positioned and sized to act in concert with a elastic assembly 120. The combined force provided by the strut 256 and the elastic assembly 120 hold, or return, the awning assembly 10 to the original position when the awning assembly 10A is unloaded.

The first and second members 94, 96 of the support arm 268 can use the elastic assembly 120 previously described in the first embodiment of the awning assembly 10. Moreover, the roller assembly 24 and the canopy 14 are the same as described in the first embodiment of the awning assembly 10. Using any of these configurations, a portion of the canopy 14 is automatically lowered when the awning assembly 10A is loaded. The lowered portion of the canopy 14 automatically returns to the original position when unloaded.

Figure 20:
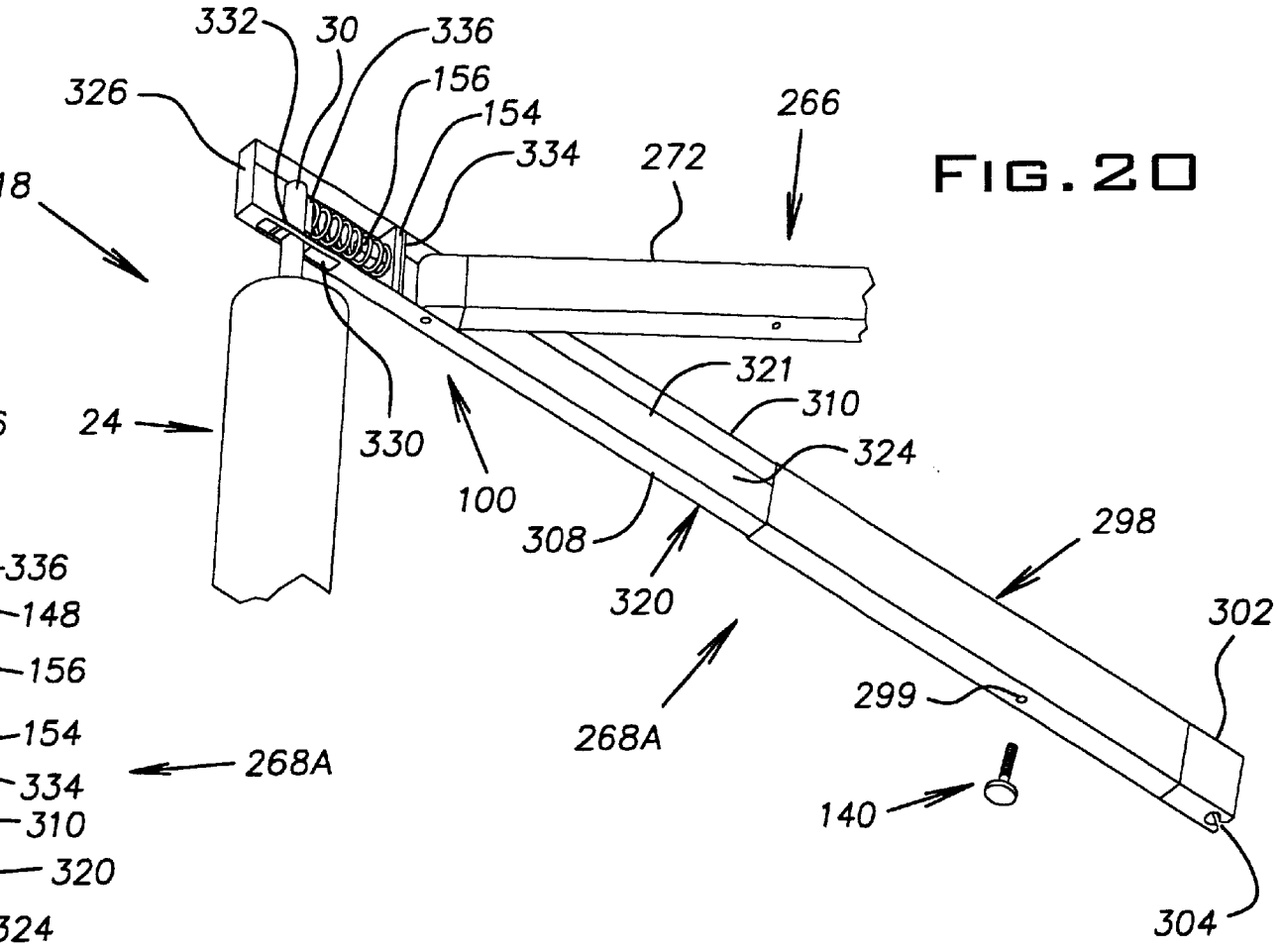
FIG. 20 is an enlarged fragmented view showing a variant of the support arm in FIG. 18.

FIG. 20 illustrates an alternative support arm 268A wherein the canopy rod 18 is automatically lowered when the awning assembly 10 is loaded, and restored to the original length when unloaded.

The support arm 268A has a bottom member 298 and a top member 320. The bottom member 298 is the same as described and shown with respect to FIGS. 18 and 19.

The top member 320 is substantially straight and elongate and is fixed in length. The top member 320 has a main wall 321 and inner and outer side walls 308, 310 which perpendicularly extend from opposed side edges of the main wall 321 to form a vertically extending and inward facing channel 324.

A suitable lock mechanism 140 is provided to secure the bottom member 298 to the first member 94 at a plurality of locations such that the length of the support arm 268 can be adjusted to the proper height to deploy and store the awning assembly 10.

Near the outer end of the top member 320 a pivot assembly 100 is provided to pivotally connected the top member 320 to the outer end of the second section 272 of the rafter arm 266. The outer end of the top member 320 supports the canopy rod 18. The canopy rod 18 preferably is a roller assembly 24.

The free end of the top member 320 is provided with an end cap 326. The end cap 326 is fixedly secured to the top member 320 preferably by rivets or screws.

A rectangular opening 330 is provided in the inner side wall 308 of the top member 320 disposed between the end cap 326 and pivot assembly 100. The rectangular opening 330 extends longitudinally. The opening 330 preferably has a height of 4 inches and has a width slightly greater than the diameter of a roller bar 30.

The bar 30 extends through the rectangular opening 330 into the channel 324. A washer 332 is provided on an inner portion of the bar 30 which extends into channel 324. The washer 332 is fixedly secured in any known manner and is sized so that the inner portion of the bar 30 is secured within the channel 324.

The top member 320 is provided with a dividing wall 334 disposed between the bottom of the rectangular opening 330 and the pivot assembly 100. The dividing wall 334 has a planar top surface and is sized to closely fit within the channel 324 of the top member 320. The dividing wall 334 is integral to, or fixedly secured to the top member 320 by any suitable manner such as, for example, rivets or screws. The dividing wall 334 preferably is an extrusion of light weight, high strength material such as aluminum alloy.

Figure 21:
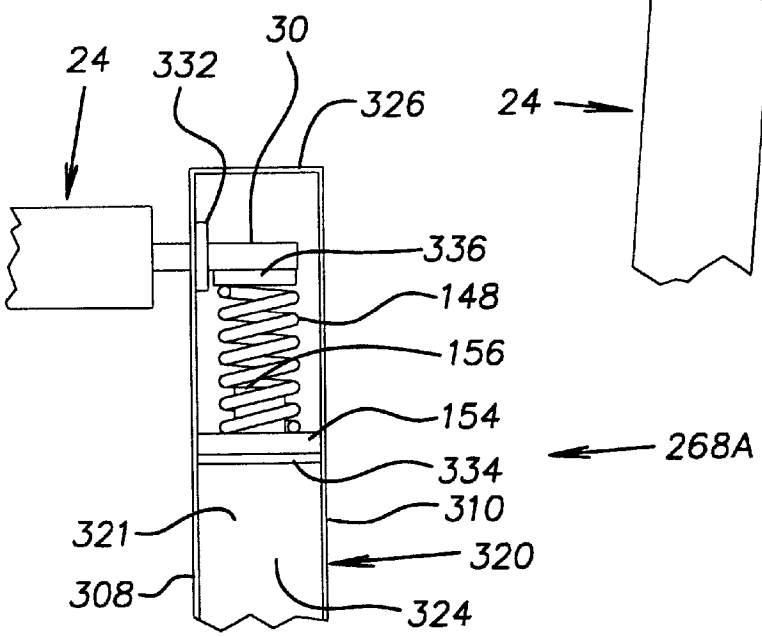
FIG. 21 is an enlarged fragmented perspective view of FIG. 20.

As illustrated in FIG. 21, the top surface of the wall 334 is provided with a spring guide 154. The spring guide 154 can be fixedly attached in any known manner to the dividing wall 334. The spring guide 154 has a center rod 156 fixedly attached in any known manner.

A first end of a compression spring 148 rests on the spring guide 154 and is disposed around the center rod 156. The center rod 156 preferably is slightly longer than the compression spring 148 when the spring 148 is fully compressed.

A second end of the compression spring 148 is attached to a platform 336 in any suitable manner. The platform 336 is sized to cover the second end of the compression spring 148 and longitudinally move within the channel of the top member 320. The platform 336 is rigid and preferably an extrusion of a light weight, high strength material such as an aluminum alloy. A roller bar 30 rests upon the platform 336.

A suitable lock mechanism 140 is provided to allow the support arm 268A to be secured in the unloaded position thereby allowing operator choice in directing the draining of collected water. When the awning assembly 10A is loaded, the compression spring 148 compresses, therefore, one end of the canopy rod 18 and a corner of the canopy 14 are lowered. The compression spring 148 returns to an original length when the awning assembly 10A is unloaded. Other configurations of spring assemblies can be utilized within the scope of the present invention. For example, a tension spring can be used by mounting the tension spring above the roller bar 30.

Other configurations of a support arm can be utilized within the scope of the present invention. For example, the support arm 268, or a portion thereof, can be made of a resilient flexible material. The support arm 268 is attached to the rafter arm 266 and to the canopy rod 18 in a similar manner as described in the second embodiment of the awning assembly 10A. When the awning assembly 10A is unloaded, the support arm 268 is substantially straight and elongate. When the awning assembly 10 is loaded the support arm 268 bows or deflects, thereby reducing the effective height of the support arm 268. Preferably, the effective height of the support arm 268 is reduced by about 4 inches when loaded. Energy stored in the resilient support arm 268 returns the support arm 268 to the original position once the awning assembly 10A is unloaded.

As a further example, a support arm can include a top part and a bottom part. A canopy rod 18 is attached to the top part in a manner similar as described in the second embodiment of the awning assembly 10A. A rafter arm 266 is pivotally attached to the bottom part with a pivot assembly 100. A spring joint or hinge is fixedly attached to the upper end of the bottom part and to the lower end of the top part, thereby making the bottom and top parts pivotally related. The hinge is positioned to rotate towards a support wall 12 when the awning assembly 10A is loaded. When loaded, the top member pivots with the hinge thereby reducing the effective length of the support arm. Stop members are provided to limit the pivoting so that the effective length of the support arm is reduced preferably 4 inches. Collected water, assisted by gravity, migrates toward the lower support arm and discharges from the canopy 14. Once unloaded, energy stored in the hinge returns the top part of the support arm to the original position.

The various awning assemblies 10 can be retailed with only one arm assembly having the effective length changing arm.

Although particular embodiments of the invention have been described in detail, it will be understood that the invention is not limited correspondingly in scope, but includes all changes and modifications coming within the spirit and terms of the claims appended hereto.

What is claimed is:

1. An awning assembly, comprising:

a canopy having an inner edge for connection at a wall, and an outer edge;

a plurality of arm assemblies, one of said arm assemblies, having a plurality of arm members with each arm member being connected to at least one other arm member, supporting the outer edge of said canopy; and an elastic assembly connected to said arm assembly, wherein said elastic assembly cooperates with said arm assembly to permit relative movement between at least two arm members and automatically responding to collection of a predetermined weight on said canopy to change the effective length of said arm assembly in response to collection of the predetermined weight on said canopy, thereby causing an edge of said canopy to lower and remove some of the collected weight from said canopy.

2. The awning assembly according to claim 1, wherein the predetermined weight is in a range of 8 pounds to 50 pounds.

3. The awning assembly according to claim 1 wherein the change in effective length is at least three inches.

4. The awning assembly according to claim 1, wherein said awning assembly further comprises a canopy rod connected to said canopy and having opposite ends each supported by one of said arm assemblies.

5. The awning assembly according to claim 4, wherein each of said arm assemblies includes a vertically extending base arm connected to said wall, a bottom arm having an inner end pivotally connected to said base arm, an extended arm having an inner end pivotally connected to said bottom arm and an outer end connected to and supporting said canopy rod, a top arm having an inner end pivotally connected to said base arm above said bottom arm and an outer end pivotally connected to said extended arm.

6. The awning assembly according to claim 5, wherein at least one of said top and bottom arm includes a second member slidably connected to a first member, and said elastic assembly connected to at least one of said first and second member.

7. The awning assembly according to claim 6, wherein said second member is slidably moveable with respect to said first member in a telescoping manner.

8. The awning assembly according to claim 7, wherein said elastic assembly includes a rack attached to said second member, a pinion attached to said first member and engaging said rack, and a spring attached to said pinion.

9. The awning assembly according to claim 8, wherein the spring is a torsion spring.

10. The awning assembly according to claim 5, wherein said extended arm includes a first member and a second member pivotally connected, and said elastic assembly is connected to at least one of said members.

11. The awning assembly according to claim 5, wherein at least one of said top, bottom and extended arm further includes a lock assembly operable to keep at least one of said top, bottom and extended arm from changing effective length when said awning assembly is loaded.

12. The awning assembly according to claim 5, wherein at least one of said arm assemblies further includes a strut having an inner end connected to said wall and an outer end connected to said top arm.

13. The awning assembly according to claim 5, wherein at least one of said arm assemblies further includes a strut having an inner end connected to said arm assembly and an outer end connected to said top arm.

14. The awning assembly according to claim 4 wherein said canopy rod includes two bars pivotally connected at their inner ends and having outer ends supported by said arm assemblies and said elastic assembly is connected to at least one of the bars.

15. The awning assembly according to claim 4, wherein said each of said arm assemblies includes a rafter arm having an inner end pivotally connected at said wall and an outer end pivotally connected to a support arm, said support arm having an outer end connected to and supporting said canopy rod and an inner end connectable at said wall.

16. The awning assembly according to claim 15, wherein at least one of said support arm further include a lock assembly operable to keep at least one of said support arm from changing effective length when said awning assembly is loaded.

17. The awning assembly according to claim 16, wherein at least one of said support and rafter arm includes a second member slidably connected to a first member and said elastic assembly connected to at least one of said first and second member.

18. The awning assembly according to claim 17, wherein said second member is slidably moveable with respect to said first member in a telescoping manner.

19. An awning assembly, comprising:

a canopy having an inner edge for connection at a wall, and an outer edge;

a canopy rod connected to the outer edge of said canopy and having opposite ends;

a pair of arm assemblies supporting the opposite ends of said canopy rod; each arm assembly includes a rafter arm and a support arm, each rafter arm having an inner end pivotally connected to said wall and an outer end pivotally connected to said support arm, said support arm having an outer end connected to and supporting said canopy rod and an inner end connectable to said wall, wherein one of said support arms is made of a resilient flexible material such that the support arm deflects to sufficiently reduce the effective length of said support arm when a predetermined weight has collected on said canopy so to remove some of the collected weight from said canopy.

20. An awning assembly, comprising:

a canopy having an inner edge for connection at a wall, and an outer edge;

a pair of arm assemblies supporting the outer edge of said canopy;

a canopy rod having the outer edge connected thereto and having opposite ends each supported by one of said arm assemblies, said canopy rod includes a bar having a section made of a resilient flexible material such that the canopy rod automatically and sufficiently deflects when a predetermined weight has collected on said canopy such that an edge of said canopy is lowered to remove some of the collected weight from said canopy.

21. An awning assembly, comprising:

a canopy having an inner edge for connection at a wall, and an outer edge; and at least one arm assembly supporting the outer edge of said canopy, wherein said canopy has a section made of a material of higher elasticity than a remaining portion of said canopy such that the section of said canopy stretches more than the remaining portion to form a valley in said canopy when a predetermined weight has collected on said canopy.

22. An awning assembly, comprising:

a canopy having an inner edge for connection at a wall, and an outer edge;

a canopy rod having angularly extending grooves in which the outer edge of said canopy is connected, and having opposite ends, said grooves extending at oblique angles to a longitudinal extent of said canopy rod; and a pair of arm assemblies supporting the opposite ends of said canopy.

23. The awning assembly according to claim 22, wherein said grooves twist between about 90 degrees and 180 degrees around the canopy rod.

* * * * *